US008016276B2

(12) United States Patent
Geier et al.

(10) Patent No.: US 8,016,276 B2
(45) Date of Patent: Sep. 13, 2011

(54) INCREMENTAL GEAR FOR BAR CLAMP

(75) Inventors: Manfred Geier, Puchheim (DE); Ralf Strauβ, Huntersville, NC (US); Phil Reed, South Yorkshire (GB)

(73) Assignee: Irwin Industrial Tool Company, Huntersville, NC (US)

( * ) Notice: Subject to any disclaimer, the term of this patent is extended or adjusted under 35 U.S.C. 154(b) by 1091 days.

(21) Appl. No.: 10/566,781

(22) PCT Filed: Aug. 2, 2004

(86) PCT No.: PCT/EP2004/008640

§ 371 (c)(1),
(2), (4) Date: Jul. 17, 2007

(87) PCT Pub. No.: WO2005/011918

PCT Pub. Date: Feb. 10, 2005

(65) Prior Publication Data

US 2008/0048374 A1 Feb. 28, 2008

(30) Foreign Application Priority Data

| | | |
|---|---|---|
| Aug. 1, 2003 | (DE) | 103 35 351 |
| Aug. 1, 2003 | (DE) | 103 35 352 |
| Aug. 1, 2003 | (DE) | 103 35 353 |
| Aug. 1, 2003 | (DE) | 103 35 354 |
| Aug. 1, 2003 | (DE) | 103 35 365 |

(51) Int. Cl.
*B25B 5/16* (2006.01)

(52) U.S. Cl. ..... 269/6; 269/3; 269/95; 269/254 CS

(58) Field of Classification Search ..... 269/6, 3, 269/225, 166, 170, 169, 95, 254 CS
See application file for complete search history.

(56) References Cited

U.S. PATENT DOCUMENTS 4,381,105 A 4/1983 Goff et al.

(Continued)

FOREIGN PATENT DOCUMENTS

DE 8703378.8 3/1987

(Continued)

OTHER PUBLICATIONS

"Pony Steel Bar Clamp Fixtures" styles 50, 52 and 56. Publication source and date unknown. It is believed that this publication was available to the public prior to Jul. 15, 1993.

(Continued)

*Primary Examiner* — Lee D Wilson
(74) *Attorney, Agent, or Firm* — Dennis J. Williamson; Andrew D. Gerschutz; Moore & Van Allen PLLC

(57) ABSTRACT

The invention relates to a clamping and/or spreading tool having a stationary jaw and a support to which the stationary jaw is fixedly connected. A push or pull rod is slideably supported on the support and a movable jaw is fixedly arranged on the push or pull rod, wherein the clamping and/or spreading tool is designed to displace the push or pull rod relative to the fixed jaw in an advance direction. The clamping and/or spreading tool further comprises at least one trigger with at least two lever configurations, wherein a mechanism for switching from a first lever configuration to a second lever configuration is provided. At least two active levers are engageable with the push or pull rod via at least one driver to displace the push or pull rod in an advance direction.

14 Claims, 11 Drawing Sheets

U.S. PATENT DOCUMENTS

| | | | | |
|---|---|---|---|---|
| 4,563,921 | A | 1/1986 | Wallace | |
| 4,850,254 | A | 7/1989 | Burney | |
| 4,874,155 | A | 10/1989 | Goul | |
| 4,893,801 | A | 1/1990 | Flinn | |
| 4,926,722 | A | 5/1990 | Sorensen et al. | |
| 4,989,847 | A | 2/1991 | Chapman | |
| 5,005,449 | A | 4/1991 | Sorensen et al. | |
| 5,009,134 | A | 4/1991 | Sorensen et al. | |
| 5,022,137 | A | 6/1991 | Sorensen et al. | |
| D320,919 | S | 10/1991 | Sorensen | |
| 5,094,131 | A | 3/1992 | Sorensen et al. | |
| 5,096,170 | A | 3/1992 | Albin | |
| D328,846 | S | 8/1992 | Sorensen et al. | |
| 5,161,787 | A | 11/1992 | Hobday | |
| 5,170,682 | A | 12/1992 | Sorensen et al. | |
| D333,963 | S | 3/1993 | Goodman | |
| 5,197,360 | A | 3/1993 | Wooster, Jr. | |
| 5,217,213 | A | 6/1993 | Lii | |
| 5,222,420 | A | 6/1993 | Sorensen et al. | |
| 5,454,551 | A | 10/1995 | Hobday | |
| D366,819 | S | 2/1996 | Wooster, Jr. et al. | |
| D366,820 | S | 2/1996 | Wooster, Jr. et al. | |
| 5,775,680 | A | 7/1998 | Sorensen et al. | |
| 5,826,310 | A | 10/1998 | Hobday | |
| 5,853,168 | A | 12/1998 | Drake | |
| 5,988,616 | A | 11/1999 | Fuller et al. | |
| 6,254,073 | B1 | 7/2001 | Noniewicz et al. | |
| 6,302,386 | B1 | 10/2001 | Fuller et al. | |
| 6,338,475 | B1 | 1/2002 | Ping | |
| 6,347,791 | B1 | 2/2002 | Chervenak | |
| 6,367,787 | B1 | 4/2002 | Poole et al. | |
| 6,382,608 | B1 | 5/2002 | Michell | |
| 6,386,530 | B1 | 5/2002 | Marks | |
| 6,412,767 | B1 | 7/2002 | Beckmann et al. | |
| 6,474,632 | B1 * | 11/2002 | Liou | 269/6 |
| 6,578,837 | B1 * | 6/2003 | Blank et al. | 269/6 |
| 6,585,243 | B1 | 7/2003 | Li | |
| 6,648,315 | B1 | 11/2003 | Lee | |
| 6,860,179 | B2 | 3/2005 | Hopper et al. | |
| 6,929,253 | B2 | 8/2005 | Marks | |
| 7,090,209 | B1 | 8/2006 | Rowlay | |
| 7,131,642 | B1 | 11/2006 | Rowlay et al. | |
| 7,624,974 | B2 | 12/2009 | Zheng | |
| 7,651,078 | B2 * | 1/2010 | Geier et al. | 269/6 |
| 7,815,175 | B2 * | 10/2010 | Cicenas et al. | 269/6 |
| 2003/0080485 | A1 | 5/2003 | Lo | |
| 2004/0195746 | A1 | 10/2004 | Marks | |
| 2007/0194510 | A1 * | 8/2007 | Geler et al. | 269/6 |
| 2008/0048374 | A1 * | 2/2008 | Geier et al. | 269/225 |

FOREIGN PATENT DOCUMENTS

| | | | |
|---|---|---|---|
| DE | 3813768 | A1 | 4/1988 |
| DE | 3917473 | A1 | 5/1989 |
| DE | 69430248 | T2 | 11/1994 |
| DE | 29603811 | U1 | 3/1996 |
| DE | 29605900 | U1 | 3/1996 |
| DE | 19731579 | A1 | 7/1997 |
| DE | 29803238 | U1 | 2/1998 |
| DE | 19861130 | A1 | 6/1998 |
| EP | 0997232 | A2 | 6/1998 |
| FR | 2611160 | | 7/1994 |
| GB | 2375985 | A | 5/2001 |
| GB | 2381231 | A | 10/2001 |
| TW | 136083 | | 6/1990 |
| WO | 0156747 | A1 | 8/2001 |
| WO | 03013793 | A1 | 2/2003 |

OTHER PUBLICATIONS

Bessey Steel Bar Clamp Fixture RS 75 instructions. Publication source and date unknown. It is believed that this publication was available to the public prior to Jul. 15, 1993.

Advertisement for Bessey Bar Clamps Styles 52, 53 and 56. Publication source and date unknown. It is believed that this publication was available to the public prior to Jul. 15, 1993.

Advertisement for Bessey Bar Clamps Styles 43 and 45. Publication source and date unknown. It is believed that this publication was available to the public prior to Jul. 15, 1993.

Advertisement for Gross Stabil Clamp. Publication source and date unknown. It is believed that this publication was available to the public prior to Jul. 15, 1993.

"Pony Clamp Fixtures" styles 50, 52, 53 and 56. "Jorgensen Style 3500 Aluminum Bar Clamps". "Jorgensen Style 7200 Steel I-Bar Clamps". Publication source and date unknown. It is believed that this publication was available to the public prior to Jul. 15, 1993.

"Catalog—American Tool Companies, Inc.," advertisement of American Tool Companies, Inc., pp. 2-1 through 2-3 and 2-5 through 2-6. It is believed that the catalog was published in Oct. 1997.

* cited by examiner

INCREMENTAL GEAR FOR BAR CLAMP

The invention relates to a stepping gear or an incremental actuator for a tool for generating a clamping and/or spreading force including a reciprocating slide bar (push or pull rod), a stationary jaw, a carrier fixedly connected to the stationary jaw on which the reciprocating slide bar is movably mounted and a jaw fixedly arranged on the slide bar.

One such tool, termed a quick-action bar clamp, is disclosed in DE 39 17 473. This quick-action bar clamp has an incremental actuator for incrementally displacing the slide bar together with the movable jaw relative to the fixed jaw. The incremental actuator is achieved by causing an actuating lever to engage a tiltable follower on the slide bar for a defined lever ratio. The follower is displaced against the bias of a return spring. When the actuating lever is pivoted, the follower is tilted on the slide bar to advance the slide bar relative to the fixed jaw. A return lock prevents backslip of the reciprocating slide bar. The return lock is tilted relative to the reciprocating slide bar such that any movement of the reciprocating slide bar contrary to the advance direction is prevented. When an item is clamped between the two jaws a closed positive connection circuit is created from the stationary jaws via the return lock into the slide bar and the movable jaw. This quick-action bar clamp suffers from the disadvantage that incrementing, for one thing, is very small so that clamping necessitates "pumping" the bar clamp several times, and, for another, high actuating forces need to be applied to generate a high clamping force between the jaws.

EP 0 997 233 discloses a clamping tool in which the lever ratios of the trigger can be varied with increasing clamping force to smaller displacements by the trigger having a mounting opening configured as a slot through which a mounting pin passes fixedly mounted on the carrier. With such a clamping tool only minor incremental increases or merely unsubstantially higher clamping forces are achievable. Apart from this, to achieve the smaller lever ratios a spring bias needs to be overcome so that although the lever ratios are diminished in favor of simple actuation, any force savings are cancelled out, at least in part, by the spring bias. Changing the lever ratios to a shorter active lever, in other words shorter advance distance, necessitates, for one thing, working against a positioning spring which urges the pivot mount point in the direction of the lever configuration for greater increments, and for another, the clamping forces between the jaws cannot be increased during the phase in changing the lever configuration. Thus, the known incremental actuator fails to implement any change in the lever configuration without ensuring a continual increase in the clamping forces at the jaws in the course of the actuating lever distance.

It is the object of the invention to overcome the disadvantages of the prior art by providing a stepping gear or an incremental actuator for a clamping and/or spreading tool permitting achieving large and small increments of advance distance whilst losses in force and distance in changing the lever configuration are to be best eliminated by keeping the structure of the incremental actuator configuration simple.

This object is achieved as set forth in claim 1 or 5.

Now, with two defined lever configurations each actuatable separate from the other and directly applicable, force and distance losses due to continual changes in the active lever and the associated disadvantages are eliminated. In addition, the system in accordance with the invention now makes it possible to provide advance distances for the clamping and/or spreading tool which are great for a quick closing operation of the clamping jaws and small as regards the generation of great clamping forces, the actuation distances to be overcome being the same for both operation situations.

In one preferred further embodiment of the invention a large increment distance lever configuration with a distance active lever determined by the spacing of the pivot mount of the trigger or operating arm from the force transmission location to a follower, entraining element or driver cooperating with the reciprocating slide bar, and a small increment force lever configuration with a force active lever are provided which is defined in the same way as the distance active lever in taking into account the other force transmission location in each case. With the incremental actuator or stepping gear in accordance with the invention translation ratios of distance active lever to force active lever are now achievable of at least approx. 1.5, between 1.5 and 2, of at least approx. 2, of at least approx. 2.2, between 2 and 5, exceeding 5, between 5 and 5.5 or at least approx. 5.5.

In one preferred aspect of the invention the incremental actuator can be operated with two alternative active lever configurations which are more particularly effective exclusively alternatively. Thus, in a first operating condition a distance lever configuration is effective and in a subsequent or second operating condition a force lever configuration is effective. Other operating conditions are just as possible with the invention, especially since in one preferred aspect of the invention two different lever configurations are actuated simultaneously, the one being defined to override the other.

In a first alternative aspect of the invention the at least two lever configurations are configured by an operating arm or a trigger having a permanent pivot mount point. In a second alternative aspect of the invention the two lever configurations are achieved by at least two triggers, at least one of which, preferably both, featuring a permanent pivot mount point.

An independent inventive aspect of the invention relates to an incremental actuator for incrementing the reciprocating slide bar together with the movable jaw relative to the fixed jaw in the advance direction with at least two different increments and comprising at least one trigger or operating arm for actuating at least two lever configurations. In accordance with the invention a means for switching a force lever configuration into a second lever configuration is provided, whereby in accordance with the invention the switching means is devised so that when activated, more particularly in a predefined operating condition, the activated lever configuration has direct, smooth engagement. In this manner, an operational change of the incremental gear according to the invention without intermediate stroke and without interrupting the advance can be achieved.

In an alternative preferred aspect of the invention at least one, preferably precisely one pivotally mounted trigger comprising two active levers is provided for the at least two lever configurations. Preferably these two active levers are directly activatable with no transition. The at least two active levers are preferably devised for engaging at least one, preferably at least two, follower(s), driver(s) or entraining element(s) displaceable against the bias of a return spring lever force transmissionwise.

As explained above, with the known two-increment actuator changing the lever configuration can only be achieved by shifting the pivot mount arm on the trigger, requiring the operator to accept a partial actuating stroke with no increase in force at the jaws. This loss of actuating direction and force is compensated by the arrangement in accordance with the invention.

In another preferred further embodiment of the invention the means for switching from one lever configuration to another lever configuration is automatically completed without the assistance of the operator for a predefined clamping force. In this arrangement a viewing window may be provided on the carrier of the tool to display the operation of the corresponding lever configuration to the operator.

In another preferred further development the switching means is formed by a mechanism for parting a coupling structure which may be configured in accordance with the coupling component as mentioned above. The mechanism for parting the coupling structure, in other words the decoupling means, is preferably intended for being configured between the trigger and a follower. Preferably the decoupling means is devised as a load-dependent release means, more particularly configured as a spring-loaded force or notch mechanism.

In a special aspect of the invention, activating the decoupling means releases a lever configuration, more particularly the distance lever configuration, in favor of another lever configuration, more particularly the force lever configuration. Since the force lever configuration during operation of the incremental actuator is always maintained activatable, the incremental actuator experiences no loss of actuation distance.

In another special aspect of the invention the decoupling means comprises a force release threshold, on violation of which the decoupling means separates a follower from the trigger. Preferably the force release threshold is greater than the return spring force acting on a follower to thus ensure that it is not the return mechanism of a return spring that achieves release or activation of the decoupling means. The decoupling means may also be provided with an overload release threshold which is particularly relevant in force operation and on violation of which the small increment lever configuration is deactivated or disconnected to prevent damage to the incremental actuator by excessively high actuating forces applied by the operator.

In another preferred further embodiment of the invention a recoupling means is provided to reinstate a parted coupling between a follower and the trigger. The recoupling means is intended to be preferably positioned so that there is no need to clasp the clamping and/or spreading tool. Preferably the recoupling means can be actuated via a lock usually provided to prevent displacement (backslip) of the reciprocating slide bar contrary to the advance direction following actuation of the trigger in thus permitting simultaneously availability, i.e. with one handle, of both release of the lock as well as activating the coupling between follower and trigger.

The trigger is provided with at least two lever configurations with differing active levers, the trigger permitting engagement with the reciprocating slide bar by the at least two different active levers via at least two followers displaceable against the bias of at least one return spring. Providing at least two followers, each responsible for an incrementing action, forms separate force engagements with the reciprocating slide bar in using just one trigger. To achieve different lever configurations at least two force transmission locations need to be provided on the trigger which determine the corresponding lever configuration of the incremental actuator. This aspect in accordance with the invention has more particularly the ergonomic advance that a multi-increment actuator is provided permitting operation with just a single trigger, whereby each increment can be exactly adapted to the operational requirements in each case. Thus, when in force operation high clamping forces are needed at the jaws, a predefined force transmission location on the trigger is selected with which short lever ratios are formed and which is to be connected to one of the followers, whereas in distance operation a corresponding force transmission location is to be defined which forms the desired lever configuration for a large increment and which is to be connected to one of the followers.

In another preferred aspect of the invention at least two return springs are provided for the at least two followers. Each of the two return springs produces, for one thing, separate return of the followers and thus also of the trigger.

In another preferred embodiment of the invention it is required that at least one follower in the non-actuated operating condition of the trigger be urged into a tilted position on the reciprocating slide bar. A return spring may be provided as such a bias or constraint means in one preferred aspect of the invention. This arrangement in accordance with the invention achieves an increase in the increment produced by the actuating stroke of more than 15% as compared to the incremental actuator of known clamps. In addition, now a spring force no longer needs to be overcome on every actuating stroke in forcing the follower into the tilt engaging the reciprocating slide bar. Now, instead, releasing the tilt is functionally individualized for an operating condition when the reciprocating slide bar actually needs to be drawn through unobstructed by the support.

In another preferred aspect of the invention a return spring is intended to act on a follower such that the follower tiltingly contacts the reciprocating slide bar so that the follower in the non-actuated operating condition of the trigger directly acts with no delay on the reciprocating slide bar pushingly when the trigger is actuated.

In still another preferred aspect of the invention the return spring and the follower are each assigned to the other such that the follower is in permanent contact with the trigger. This arrangement provides for multi-increment actuators, more particularly multi-increment actuators permitting a smooth change in incrementing, i.e. without any intermediate stroke and interruption of the advance stroke, in other words without the trigger experiencing a partial actuating stroke with no increase in force at the jaws.

In yet another further development of the invention the trigger has a stop for stopping the follower under the active influence of the return spring. As regards the force entry location of the return spring at the follower the stop is arranged so that the follower receives a pivoting force about the stop, it being this pivoting force which maintains the follower tilted relative to the reciprocating slide bar.

In another preferred aspect of the invention the return spring features a spring rate capable of always urging the non-actuated trigger active lever supportingly into its actuating starting position in the compressed or expanded condition of the spring.

In yet another further development of the invention at least one follower, preferably at least two followers, is/are connected to the trigger via a coupling component such that the force transmission locations at the trigger and at the follower always remain in the same location, resulting in active levers being formed substantially the same throughout complete operation. The coupling component may be configured rigid, for example as a compression rod, or elastically as a spring, more particularly as a coil spring. Preferably the coupling component is intended to cause the follower to contact the reciprocating slide bar tiltingly even in the non-actuated operating condition of the trigger because of the coupling.

In yet another preferred further embodiment of the invention for coupling the at least two followers to the trigger an elastic, flexible or rigid coupling component is provided which more particularly is articulatedly connected to the trigger as well as to one of the at least two followers. Preferably the coupling component forms a multi-link chain, more particularly a two-link chain, resulting in stationary force transmission locations on the trigger and on the follower.

In still another preferred further embodiment of the invention for large increment distance operation of the incremental actuator one follower is connected to the trigger via the coupling component in forming a distance lever configuration. A further follower for small increment force operation of the incremental actuator is connected to the trigger in slip or roll contact in forming a force lever configuration remaining substantially the same.

In another preferred aspect of the invention one of the lever configurations is permanently activatable more particularly for a small increment displacement and a further lever configuration more particularly for a large increment displacement can override the activatable small increment lever configuration. When the decoupling means is deactivated the overriding lever configuration actually effects the reciprocating slide bar in displacing it more particularly in large increments, whereas when the decoupling means is activated the small increment lever configuration takes over functional operation of the incremental actuator smoothly and without delay in effectively engaging the reciprocating slide bar.

A further independent inventive aspect of the invention relates to an incremental actuator for incrementally advancing the reciprocating slide bar by two separately operable triggers or operating arms. The at least two triggers result in the reciprocating slide bar being advanced in the same direction. With this separate arrangement in accordance with the invention of two triggers for the same direction of advance it is now simple to form a multi-increment actuator, preferably a two-increment actuator.

Unlike conventional incremental actuators achieving clamping forces in the range 600 to 1,500 Newton, now with the incremental actuator in accordance with the invention clamping force six times as high are generated. The advantage of this increase in force makes itself felt not only quantitatively but also in the fact that such clamping tools are now available for a greater range of application necessitating clamping forces from 5,000 to 6,000 Newton.

In another preferred further embodiment of the invention the at least two lever configurations are formed by two separate triggers or operating arms pivotally angled on the carrier, each of which comprises its own active lever for engaging the reciprocating slide bar via a follower with the aid of a return spring lever force transmissionwise. More particularly, the individual active lever of the corresponding trigger remains substantially the same during operation.

In yet another preferred further embodiment of the invention the at least two triggers are pivotally mounted in a scissors action on the support, separate pivot mounts being provided at different locations on the carrier particularly for the triggers.

In yet another further embodiment of the invention two triggers are pivotally mounted on the support and featuring opposite directions of actuation. Preferably the at least two triggers can be pivoted in a scissors arrangement on the support.

In still another further embodiment of the invention the at least two triggers each comprise a pivot mount arranged at different locations on the support. Preferably one pivot mount is positioned on one side of the reciprocating slide bar, more particularly on the actuating side, and at least one pivot mount is positioned on the opposite side, preferably on the clamping side of the reciprocating slide bar.

In another further development of the invention a large increment distance trigger is provided being engageable with the reciprocating slide bar via a follower displaceable against the bias of a return spring, the large increment distance trigger being coupled on one actuating side and its distance active lever acting on the follower at a clamping side of the reciprocating slide bar.

In another further embodiment of the invention a distance trigger for a large increment and a force trigger for a small increment are provided. Preferably the distance trigger comprises a first portion extending substantially perpendicular to the reciprocating slide bar in the region of the engagement location with the follower and a second portion, the first and second portion partly surrounding the follower. As an alternative the second portion of the trigger may extend substantially in an axial elongation of the first portion.

In a further development of the invention, in the non-actuated operating condition of the distance trigger, its pivot mount is repositioned relative to a perpendicular to the reciprocating slide bar level with the follower contrary to the advance direction. This positional requirement of the pivot mount permits achieving very good lever configurations for incremental actuator ratios with large displacements.

In another preferred embodiment of the invention a small increment force trigger is pivotally mounted on an actuating side of the reciprocating slide bar, the force trigger permitting engagement at the actuating side of the reciprocating slide bar with a follower via which at least two triggers can cooperate operationally with the reciprocating slide bar.

In yet another preferred aspect of the invention a large increment distance trigger and a small increment force trigger are adapted to each other such that when the one trigger is actuated, the other trigger in each case functions as a supporting arm or counterarm.

In still another preferred aspect of the invention a return spring is integrated in the incremental actuator which on release of an actuating force by the operator returns the at least two triggers from their actuating end position to a starting point. In the starting point the at least two triggers are available for a complete actuating stroke.

Another further development of the invention relates to a permanent tilt of the follower. To prevent distance losses in the actuating stroke of the trigger, permanently tilting the follower ensures that a force input into the reciprocating slide bar takes place directly on actuation of the trigger.

In a preferred further embodiment of the invention a means for releasing the permanent tilt of the follower is provided in thus permitting a shift of the reciprocating slide bar, non-operationally, for opening a clamping zone between the jaws both contrary to and in the advance direction with no obstruction. Preferably the means for releasing the permanent tilt is actuated by releasing a lock preventing displacement of the reciprocating slide bar contrary to the advance direction of the incremental actuator.

In still another preferred further embodiment of the invention in distance operation of the incremental actuator a large increment distance trigger is pivotable as a countermount in utilizing a force trigger defined contrary to the actuation direction of the distance trigger whilst permitting large increment displacement of the reciprocating slide bar. In force operation a force trigger is pivotable as a counterarm in utilizing the distance trigger defined more particularly due to the lever ratios contrary to the actuation direction of the force trigger, permitting small increment displacement of the reciprocating slide bar for applying clamping and/or spreading forces.

The known clamping tool according to EP 0 997 233 suffers from the disadvantage that the actuating direction fails to correspond to the resulting advance direction of the reciprocating slide bar including the movable jaw which often results in the clamping tool being wrongly applied by an inexperienced operator. In addition, the small increment lever configuration, i.e. for high clamping forces at the jaws, features an unfavorable force profile from the actuating lever via the pivot mount zone into the actuating lever. This results in the actuating force needing to be redirected in the region of a kink at the pivot mount location to the actuating lever, as a result of which the structure particularly at the pivot mount is susceptible to fatigue. On top of this, for a small increment force lever configuration only negligibly higher clamping forces are generateable due to the low lever arm shortening and the compression spring at the oblong hole.

It is on the basis of the above that another object of the invention is to overcome the disadvantages of the prior art, in particular by providing an incremental actuator for a clamping and/or spreading tool, more particularly a bar clamp, with which high clamping forces can now be produced between the jaws whilst permitting facilitated ergonomic operation by reason of a favorable force profile.

This object is achieved by the features as set forth in claim 9.

In accordance therewith an incremental actuator is provided with a trigger or operating arm whose pivot mount is now positioned on a clamping side of the reciprocating slide bar, in other words, the side where the clamping jaws are located. Furthermore, in accordance with the invention the force transmission location of the trigger is now to be defined on a follower displaceable against the bias of a return spring on the same side as the pivot mount. In this arrangement the pivot mount as well as the force engagement location are now located relative to each other such that the actuating direction is now substantially in the same direction as the advance direction of the reciprocating slide bar. This feature in accordance with the invention now permits defining minute advance displacements by a simple design with which very high clamping forces can now be applied with no change in the actuating displacements.

Unlike conventional incremental actuators achieving clamping forces in the range 600 to 1,500 Newton, now with the incremental actuator in accordance with the invention clamping force six times as high are generated. The advantage of this increase in force makes itself felt not only quantitatively but also in the fact that such clamping tools are now available for a greater range of application necessitating clamping forces from 5,000 to 6,000 Newton.

In one preferred further embodiment of the invention the force engagement location of the trigger is now located at the follower between the pivot mount and the reciprocating slide bar, creating a favorable force profile from the actuating as applied by the operator up to the engaging location. Preferably, the pivot mount is arranged in the course of a longitudinal direction of the reciprocating slide bar substantially level with the follower to thus achieve small active levers as needed for small advance distances. On top of this, this arrangement now makes it possible to eliminate bulky structures for redirecting the actuating force.

In a further preferred aspect of the invention the pivot mount is now arranged offset in the non-actuated condition in the course of a longitudinal direction of the reciprocating slide bar relative to a perpendicular to the reciprocating slide bar level with the follower contrary to the advance direction of the incremental actuator.

In a preferred further development of the invention the trigger is provided with a permanent stationary pivot mount location to thus avoid force losses as materialize with shiftable mounting locations as utilized to change the lever ratios.

In another preferred aspect of the invention the pivot mount and the engagement location of the trigger on the follower are arranged substantially in a plane to which the reciprocating slide bar is located as the plane normal.

Preferably the trigger comprises a first portion including an active lever and a second portion at which an operator can actuate the trigger, an obtuse angle located between the first and second portion exceeding approximately 135 deg., preferably approximately 150 deg, more particularly substantially 180 deg.

So that the trigger can be returned at the end of the actuating stroke to its starting point a return spring is provided in a further embodiment in accordance with the invention.

In a further preferred aspect the follower is brought into a permanent tilted position relative to the reciprocating slide bar. For this purpose a return spring may be preferably provided which permanent acts on the follower operationally and urges the follower even in the non-actuated operating condition against a stop configured on the trigger. Via the stop the trigger is pivoted and tilted relative to the reciprocating slide bar.

In a preferred further embodiment of the invention a means for releasing the permanent tilt of the follower is provided in thus permitting a shift of the reciprocating slide bar also contrary to the advance direction in the non-actuated condition of the actuating arm. Preferably the means for releasing the tilt are actuated by releasing a lock preventing displacement of the reciprocating slide bar contrary to the advance direction of the incremental actuator.

In a special further embodiment of the invention the small increment trigger is intended to serve in a specific actuating position as a counterarm for a second trigger, especially for a large increment. On release of the small increment trigger it is then the return spring which forces the trigger back into its starting point.

So that the incremental actuator in accordance with the invention is able to produce six times the clamping force between the jaws, as compared to conventional incremental gears, an overload cutout is provided in a preferred aspect which releases and deviates the generated clamping force from the incremental gear as soon as a force release threshold is violated. Preferably the overload cutout is configured as a decoupling means which parts the connection between the follower and the trigger as the force release threshold is attained or exceeded.

The known and well proven clamping tool according to DE 39 174 473 suffers from the disadvantage that with the jaws fully open in the case of small items to be clamped the trigger needs to be "pumped" several times so that the jaws can grip the item.

The known incremental actuator provides a lever configuration achieving an incremental actuator ratio of active lever length to actuating lever length of max. 0.3, the actuating lever defining the spacing of the pivot mount from an actuating range on the trigger as normally used by the operator, maximally by the free end of the trigger opposite the pivot mount.

It is another object of the invention to provide an incremental actuator for a clamping and/or spreading tool, more particularly a bar clamp, with which large advance increments of the reciprocating slide bar are now achievable for an actuating stroke of the trigger or operating arm in a compact arrangement with small actuating space.

This object is achieved by the features as set forth in claim 11.

In accordance therewith a pivot mount of the trigger is disposed on an operating side of the reciprocating slide bar. It is understood that the actuating side is the side of the reciprocating slide bar at which an operator operates the trigger for pivoting the latter more particularly relative to a countergrip. In addition, the trigger is positioned in accordance with the invention so that a location for entering the force into the follower is provided on a side of the reciprocating slide bar opposite the actuating side, namely to a clamping side. It is understood that the clamping side is the side of the reciprocating slide bar at which the jaws of the clamping and/or spreading tool are located. The incremental actuator in accordance with the invention provides a lever configuration which now achieves substantially greater displacements for an actuating stroke than permitted by incremental actuators of known clamping and/or spreading tools. The lever configuration created by the incremental actuator in accordance with the invention now provides a substantially larger active lever responsible for the greater displacements. This now makes it possible with a clamping and/or spreading tool featuring an incremental actuator in accordance with the invention to grip even small items with the clamping jaws far apart preferably with but a single actuating stroke or at least with far fewer "pumping" actions than with the incremental actuators of known clamping and/or spreading tools.

In one further embodiment of the invention concrete lever length ratios are cited in relating the length of the active lever to the length of an actuating or active lever as achievable by the means of the invention. The actuating lever is a quantity definable from the distance of the pivot mount from the point of application as used by the operator on the trigger. The following cites the maximum length of the actuating lever as defined by the distance of the pivot mount from the opposite free end of the trigger. It is particularly for a usual length of the actuating lever of approximately 5 to 20 cm that the incremental actuator in accordance with the invention may have a lever length ratio of at least approx. 0.4; at least approx. 0.5; at least approx. 0.6; at least approx. 0.7; at least approx. 0.8; at least approx. 0.9 or at least approx. 1.

In another aspect of the invention the trigger comprises a first portion extending substantially perpendicular to the reciprocating slide bar from a force entry location at which the trigger engages the follower. Adjoining the first portion is a second portion extending inclined to the reciprocating slide bar at a non-negligible angle of preferably at least approx. 20 deg, preferably at least approx. 30 deg, preferably 45 deg at the most. Preferably the first and the second portion of the trigger partly surround the follower.

Alternatively, the second portion of the trigger may be substantially an axial elongation of the first portion.

In another preferred embodiment of the invention the pivot mount is arranged offset with reference to the perpendicular of the reciprocating slide bar level with the follower opposing the advance direction of the incremental actuator. This positional requirement of the pivot mount achieves very good lever configurations for an incremental actuator ratio with large displacements.

In another preferred aspect for providing favorable lever configurations for an incremental actuator ratio with large displacements, the pivot mount and force entry location are arranged in a plane passing through the reciprocating slide bar as the plane normal.

It is another object of the invention to provide an improved incremental actuator for a clamping and/or spreading tool, more particularly a bar clamp, ensuring transmission of a driving/actuating force to the reciprocating slide bar with a minimum loss of force and displacement for a ratio of actuation direction to advance distance which is as optimal as possible.

This object is achieved by the features of claim 12.

In accordance therewith, the trigger is connected to the follower via a coupling component ensuring a stationary force transmission. The coupling component ensures the force being transmitted always at the same location of the follower or trigger. So that shifts in the active lever are excluded. On top of this, any friction effect at the contacting surface areas is excluded, making for easier operation of the clamping and/or spreading tool. The coupling component also has inherent advantages in design, because of it resulting in greater freedom in configuring the incremental actuator.

In the invention a decoupling means at the follower and/or trigger is provided to, for example, release the tilted follower from its tilted position as dictated by the coupling component.

Furthermore, the decoupling mechanism may be devised as a means for protecting the incremental actuator from an overload applied by the operator. Should the trigger receive an excessive force, the decoupling means releases the coupling between follower and trigger. For this purpose the decoupling means may be configured as a load-dependent release means. Preferably the load-dependent release means is achieved by a spring-loaded force mechanism.

In one preferred further embodiment of the invention the coupling component is configured rigid or flexible or elastic, more particularly as a rod, preferably as a compression rod or as a spring, preferably as a coil spring. Preferably the coupling component is located substantially parallel to the reciprocating slide bar. More particularly, in the course of actuation of the trigger the coupling component is displaced axially or lengthwise in the direction of the reciprocating slide bar.

In another preferred further embodiment of the invention the coupling component is articulatedly connected to both the trigger and to the follower to thus achieve pivoting movements between the coupling component and the follower as well as between the trigger and the coupling component. In one preferred aspect a hinged link mechanism is provided for connecting the coupling component to the trigger and to the follower. In another preferred further embodiment of the invention the coupling component forms a multi-link chain, more particularly a two-link chain.

To avoid distance losses in actuating the trigger, the coupling component in accordance with the invention is preferably dimensioned so that the follower is tilted also in the non-actuated operating condition of the trigger relative to the reciprocating slide bar so that the edges of a through passage configured on the follower tiltingly contact the reciprocating slide bar.

In another further development of the invention a return spring acts on the follower such that it can be returned relative to the reciprocating slide bar when the trigger needs to be returned from its actuating position to its starting position. In this arrangement the return spring is to be selected so strong that the trigger can automatically assume its starting position. However, the return spring must only be devised strong enough so that the force acting via the follower on the load-dependent release means does not activate the decoupling means unintentionally.

In another preferred further embodiment of the invention a recoupling means is provided to reinstate a parted coupling between follower and trigger. The recoupling means is intended to be preferably positioned so that there is no need to clasp the clamping and/or spreading tool. Preferably the recoupling means can be actuated via a lock usually provided to prevent displacement of the reciprocating slide bar contrary to the advance direction (backslip) following actuating of the trigger in thus permitting simultaneous availability of both release of the lock as well as activating the coupling between follower and trigger.

The known proved incremental actuator according to DE 39 174 473 is a follower comprising a plate with a through passage substantially in the middle through which the reciprocating slide bar penetrates with clearance. In a non-actuated operating condition of the trigger the follower biased by a return spring supported by a carrier section rests on a flat of the trigger. In the non-actuated operating condition the edges of the through passage do not engage the reciprocating slide bar. In first actuating of the handlegrip (first actuation phase) the follower in producing the standby condition is pivoted relative to the reciprocating slide bar and tilted with the latter, so that in a second actuation phase in forming clamping forces, the reciprocating slide bar can be shifted in the advance direction against the bias of the return spring. On release of the trigger the biased return spring releases the tilt. The incremental actuator suffers from the disadvantage that part of the actuating distance, namely the first actuation phase for bringing the follower into the tilted engagement position gets lost for advancing the reciprocating slide bar. In addition to the loss of the actuating distance, part of the actuating force for deforming the return spring needs to be used to tilt the follower at the reciprocating slide bar to overcome the unused actuating distance.

It is another object of the invention to overcome the disadvantages of the prior art, in particular to provide an improved generic incremental actuator for a clamping and/or spreading tool, more particularly a bar clamp, on which the available drive or actuating distances are made use of optimally and the drive or actuating force applied by the operator is translated with high efficiency.

This object is achieved by the features as set forth in claim 14. According thereto, it is intended that in the non-actuated operating condition the follower is urged into a tilted position on the reciprocating slide bar. One such bias or constraint means in accordance with one preferred aspect of the invention may be a return spring. This feature in accordance with the invention achieves an increase in the increment displaceable by an actuating stroke of more than 15% as compared to the incremental actuator of known bar clamps. In addition, there is now no need for a spring force to be overcome on each actuating stroke in bringing the follower into the tilted position engaging the reciprocating slide bar. Instead, releasing the tilt is now intended to be functionally individualized into an operating condition when the reciprocating slide bar is actually required to be drawn through the carrier unobstructed.

For shifting the reciprocating slide bar in a non-actuated operating condition of the clamping tool also contrary to the advance direction a means for releasing the permanent tilt of the follower is provided particularly when the means for tilting the follower is also devised for configuring clamping forces at the follower.

In one preferred aspect of the invention the bias means is set so that to the follower in the non-actuated operating condition of the trigger is communicated a clamping force engaging the reciprocating slide bar. In this arrangement the return spring responsible therefore preferably is supported by the carrier.

In another preferred aspect of the invention the return spring and follower are assigned to each other so that the follower is held in permanent contact with the trigger. This feature now makes available multi-increment actuators, more particularly multi-increment actuators achieving a smooth change in increment, i.e. without an intermediate stroke and interruption of the advance.

In one preferred further development of the invention the trigger now has a stop for stopping the follower under the influence of the return spring. As regards the force engagement location of the return spring the stop is arranged on the follower such that to the follower is communicated a pivoting force about the stop. It is this pivoting force which maintains the follower in the tilted position relative to the reciprocating slide bar.

In still another preferred aspect of the invention the follower is connected to the trigger via a coupling component such that the force transmission locations on the trigger and on the follower always remain stationary, resulting in substantially the same active lever being formed throughout complete operation. The coupling component may be configured rigid, for example as a compressive rod or elastic as a spring, more particularly as a coil spring. Preferably the coupling component is intended to dispose the follower tilted to the reciprocating slide bar by the coupling in the non-actuated operating condition of the trigger.

In a preferred aspect of the invention this release means is actuatable via a lock which prevents backslip of the reciprocating slide bar during operation of the clamping tool contrary to the displacement effect. Preferably releasing the lock as well as releasing the tilt of the follower is achieved by simultaneously actuating the lock. For this purpose a structural coupling of the lock with the follower is to be provided.

In still another preferred aspect of the invention the release means is configured as a decoupling means effective in the alternative aspect of a coupling component. The decoupling means parts the trigger from the follower so that the latter no longer remains in its tilting biased position. Preferably the decoupling means is a load-dependent release means, more particularly a spring loaded latch mechanism.

In another preferred further development of the invention the release means features a minimum load threshold set so that the return spring acting on the follower is unable to activate the release means in thus preventing any unintentional release or parting of the coupling between follower and trigger during operation. Furthermore an overload threshold may be provided set to protect the incremental actuator and the tool from excessive actuating forces.

The invention relates to a tool for generating a clamping and/or spreading force, more particularly a bar clamp, including a reciprocating slide bar, a stationary jaw, a support fixedly connected to the stationary jaw on which the reciprocating slide bar is movably mounted, a movable jaw fixedly arranged on the reciprocating slide bar and an incremental actuator in accordance with the invention.

For example, an incremental actuator may be configured with at least two followers and a switching means or an incremental actuator may comprise a two-trigger arrangement and a means for switching from one lever configuration to another lever configuration.

Further advantages, features and properties of the invention will now be detailed by the description of two preferred embodiments of the invention with reference to the drawings in which.

Figure 1:
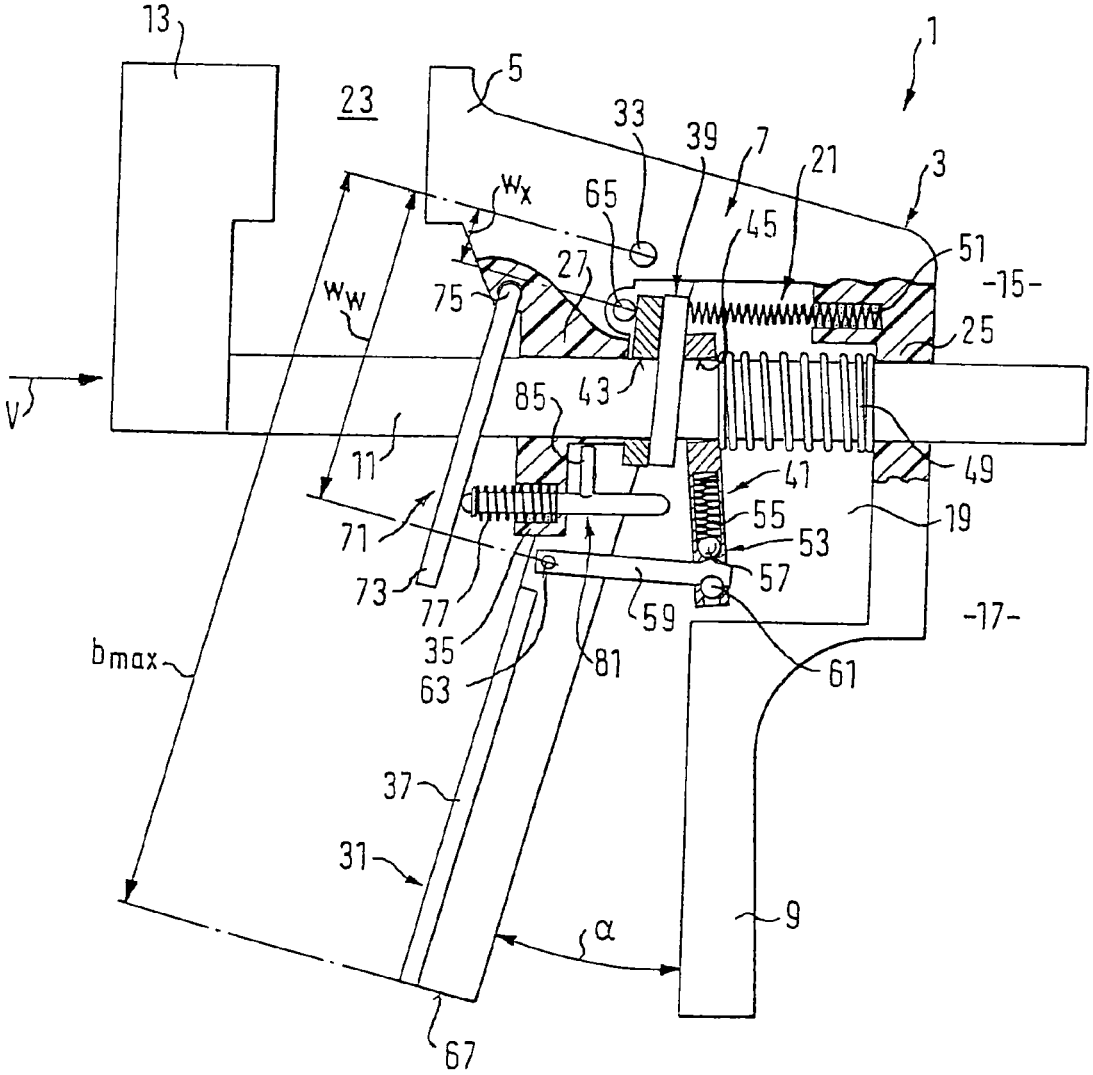
FIG. 1 is a side view of a tool in accordance with the invention in the configuration as a bar clamp including a dual mode incremental actuator, shown in the idle position.

The bar clamp 1 as shown in FIGS. 1 to 5 includes a carrier or support 3 comprising a fixed jaw 5, a housing 7 and a handle grip 9, and a slide bar or push rod 11 movably mounted on the carrier 3, at the end of which a movable jaw 13 is fixedly attached, for example, by means of rivets or releasably by a quick-action latch mechanism. The jaws 5 and 13 may be arranged facing each other (clamping tool) or facing away from each other (spreading tool). The fixed jaw 5 and movable jaw 13 are arranged on a clamping side 15 of a longitudinal centerline of the slide bar 11. The handle grip 9 is arranged on an actuating side 17 of the longitudinal centerline of the slide bar 11.

The housing 7 defines a cavity 19 dimensioned to accommodate, at least in part, the members of a dual-mode incremental actuator 21 having two different increments. Referring now to FIG. 1 there is illustrated the fixed jaw 5 and movable jaw 13 in an open position relative to each other, a clamping zone 23 being defined between the jaws 5, 13. It is in this clamping zone 23 that an item (not shown) can be clamped.

For simple manufacture of the bar clamp in accordance with the invention the fixed jaw 5 and housing 7 and handle grip 9 are made in one piece, more particularly injection molded in plastics material.

The slide bar 11 as well as the movable jaw 13 are defined movable to the effect that they can be moved relative to the carrier 3. The slide bar 11 is shiftingly mounted axially on the carrier at two radial mounting portions 25, 27 for introducing radially acting mounting forces from the slide bar 11 into the carrier 3 or from the carrier 3 into the slide bar 11.

The incremental actuator 21 is designed for incremental displacement of the movable slide bar 11 including the movable jaw 13 in an advance direction V. The incremental actuator 21 in accordance with the invention comprises as a drive a trigger or operating arm 31 which is pivotally mounted via a pivot mount 33 on the carrier 3.

In a non-actuated operating condition of the trigger 31 (FIG. 1) a portion of the side of the trigger 31 facing away from the handle grip 9 is stopped by a stop formed by a portion 35 of the carrier 3 at the actuating side.

The trigger 31 has a handle grip inlay 37 made of a material having a high friction coefficient, such as rubber. On operation of the bar clamp 1 an operator (not shown) clasps the handle grip 9 such that the handle grip inlay 37 is gripped by at least the middle finger and/or index finger whilst the handle grip 9 rests in the palm of the hand as a counterhold.

The incremental actuator in accordance with the invention has a force follower or driver 39 and a distance follower 41. Both followers 39 and 41 comprise a through passage 43 and 45 respectively, the dimensioning of which in each case is dimensioned relative to the constant cross-section of the slide bar 11 such that the slide bar 11 is adapted in clearance to the longitudinal centerline of the slide bar 11 in a vertical position of the followers 39, 41.

Biasing the distance follower or driver 41 is a return spring 49 located as a coil spring about the slide bar 11 and which is supported on one hand by the inner side of the slide bar mount 25 and biasing on the other hand the distance follower 41 contrary to the advance direction V. In the non-actuated operating condition of the incremental actuator 21 as shown in FIG. 1 too, the return spring 49 biases the distance follower 41.

Arranged in a substantially parallel orientation to the return spring 49 at the clamping side 15 is a return spring 51 which is supported on the one hand in a blind hole location provided in the carrier 3 and on the other hand biases the force follower 39.

In the non-actuated operating condition of the incremental actuator 21 as shown in FIG. 1 the return spring 51 is urged against a clamping side 15 portion of the force follower 39. The force follower 39 is formed by two plates dimensioned the same, one plate engaging the return spring 51, the other plate cooperating with the trigger 31 operationally as detailed below.

The distance follower 41 comprises at the actuating side (17) an elongation accommodating a load-dependent decoupling means 53. The decoupling means 53 serves to permit scissors action of the trigger 31 with the distance follower 41 when a predefined actuating force threshold, i.e. a load threshold acting on the decoupling means 53 is exceeded. The elongation of the distance follower 41 comprises a recess for receiving a biasing spring 55 biased. The biasing spring 55 acts on a ball 57 which in the deactivated condition (FIG. 1) of the decoupling means 53 is urged against a dished end portion of a coupling rod 59. The end portion of the coupling rod 59 is provided with a dished operator receiving a pin 61 via the biasing spring 55 in the deactivated condition (FIG. 1) of the decoupling means 53. The predefined load threshold of the force release threshold can be predefined by the spring rate of the biasing spring 55 as well as the dimensioning of the pin 61 and of the dished end portion of the coupling rod 59.

The operating condition of the incremental actuator 21 in which the decoupling means 53 is activated in permitting scissors action of the trigger 37 with the distance follower 41 is detailled further on.

The coupling rod 59 prevents in the deactivated condition (FIG. 1) of the decoupling means 53 a relative movement between the distance follower 41 and trigger 31. Due to a hinge-like pin and dished arrangement on the one hand and a hinged link 63 on the other, the coupling rod 59 forms a two-hinged link chain for coupling the trigger 31 to the distance follower 41, resulting in stationary force transmission locations (65).

The hinged link 63 defines a permanent distance active lever ww which is effective when the decoupling means 53 is deactivated, i.e. the trigger 31 is coupled to the distance follower 41. The length of the distance active lever ww relevant for the large increment distance operation mode of the incremental actuator 21 is determined by the spacing of the pivot mount 33 of the trigger 31 and the hinged link 63.

The second operating condition (FIGS. 3 and 4) of the dual mode incremental actuator 21 is defined by a force active lever wk, the length of which is determined by the spacing of the pivot mount 33 from a force transmission location on the trigger 31 formed by a force transmission location 65 secured to the trigger.

An actuating lever $b_{max}$ is the same for both operating conditions, i.e. distance operating condition and force operation condition, reference being made in this case merely to the longest actuating lever by corresponding operation, for a better understanding of the Figs., as defined by the spacing of the pivot mount 33 of the trigger 31 away from the end 67 of the trigger 31 at the free actuating side.

Provided at the side of the housing 7 facing the clamping zone 23 is a lock 71 which prevents displacement (backslip) of the slide bar 11 contrary to the advance direction V. The lock 71 comprises an actuating portion 73 and a mounting part 75 pivotally mounted in a C-shaped recess configured in the carrier 3. A biased locking spring 77 urges the lock 71 into the position as shown in FIGS. 1 to 4 inclined to the longitudinal centerline of the slide bar 11 passing through the lock 71 in a through passage (not shown) adapted in clearance to the dimensioning of the slide bar 11.

In the inclined position as shown in FIGS. 1 to 4 the lock 71 with its lateral edges (not shown) is tilted with the slide bar 11 such that the clamping forces produced at the tilted portions by means of the locking spring 77 prevent the slide bar 11 from being returned contrary to the advance direction V (backslip) in thus maintaining the clamping forces produced at the fixed jaw 5 and movable jaw 13.

Provided at the actuating side 17 of the slide bar 11 is a recoupling means 81 shiftingly mounted as an elongated component in a mounting recess in the carrier portion 35. The locking spring 77 forces the elongated component into contact with the actuating portion 73 of the lock 71. A detailed description of the function of the recoupling means 81 is given below.

Individual, more particularly independent aspects of the invention will now be described as relating more particularly to the functional relationship of the individual components of the incremental actuator 21 in accordance with the invention and the tool in accordance with the invention.

Distance Operation of the Incremental Actuator 21

As indicated above, the incremental actuator in accordance with the invention has two increments or two different advance distances for a full actuating stroke of the trigger 31. The operating condition will now be explained in which large advance distances are achieved on an actuating stroke as defined by the angle between the handle grip 9 and the trigger 31.

In distance operation for displacing the slide bar 11 together with the movable jaw 13 the distance active lever ww is effective. No forces occur at the fixed jaw 5, as a result of which actuating the trigger 31 is already possible with a small force which, however, is not sufficient to activate the decoupling means 53, i.e. to urge the pin 61 from the dished recess of the coupling rod 59 by the biasing spring 55 being compressed.

Pivoting the trigger 31 displaces the slide bar 11 via the distance follower 41 tilted with the slide bar 11 in the advance direction V by the increment of the distance operation coupled to the return spring 49. The return spring 49 must only be dimensioned strong enough that it communicates in none of its compressed conditions a force to the distance follower 41 which is stronger than the release force threshold needed to activate the decoupling means 53.

On completion of the full actuating stroke (see FIG. 2) the trigger 31 contacts the handle grip 9 and the return spring 49 is in its maximally compressed position. When the operator releases the trigger the return spring 49 urges the trigger 31 via the distance follower 41 coupled thereto into its idle position as shown in FIG. 1 in which it rests against the stop on the actuating side portion 35.

Figure 2:
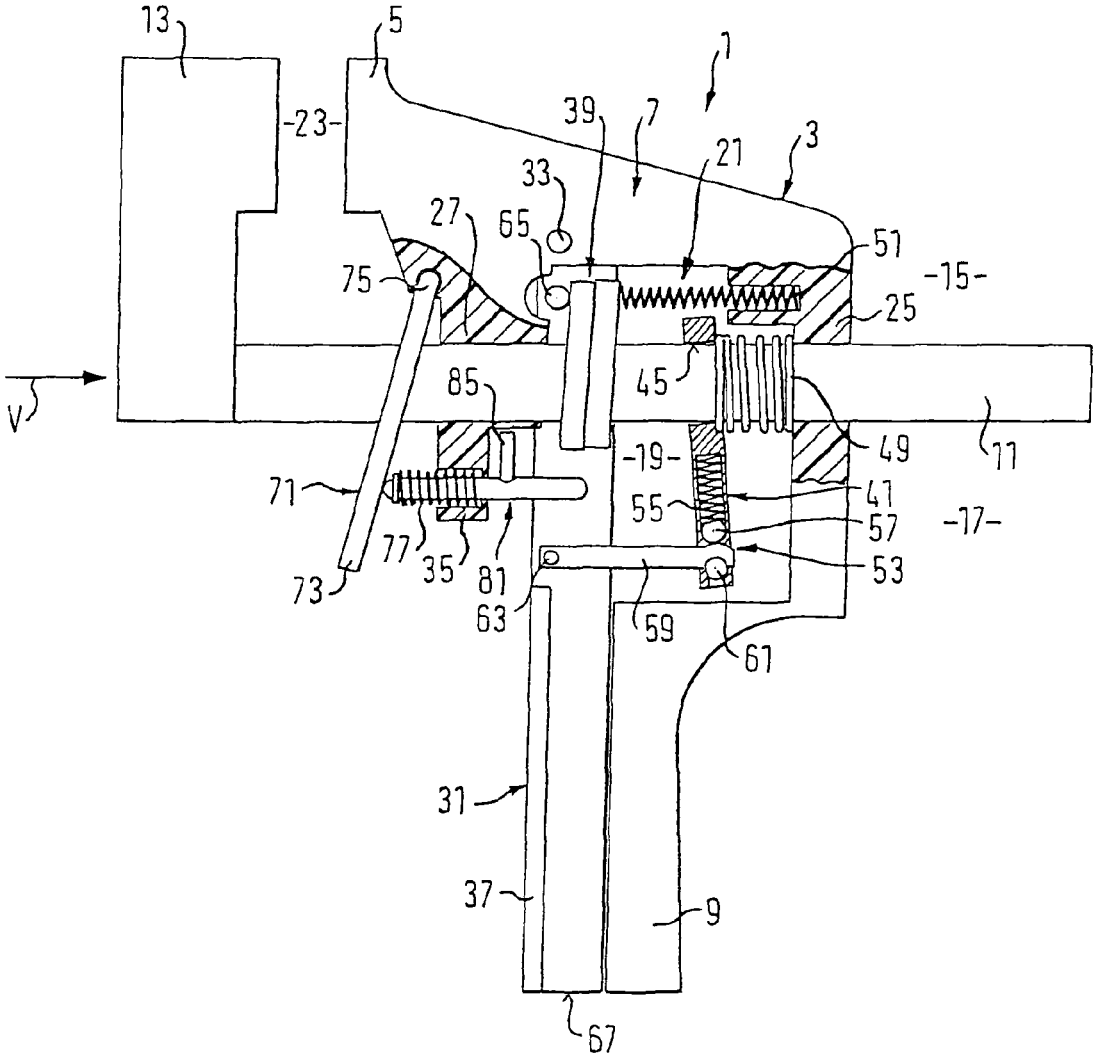
FIG. 2 is a side view of the tool as shown in FIG. 1, showing the end of an actuating stroke of the large-increment distance actuation mode.

Referring now to FIGS. 1 and 2 illustrating the idle position and the end position of the trigger in distance operation of the incremental actuator 21 it is evident that also during large increment distance operation the force transmission location 65 of the trigger 31 engages the force follower 39 and thus in distance operation of the trigger 31 too, the force follower 39 is shifted in accordance with the actuating stroke of the trigger 31 and the force active lever wk in the advance direction V. Although the advance of the force follower 39 in the advance direction V does not effectively determine the displacement of the slide bar 11 in distance operation of the incremental actuator 21, because the advance rate of the slide bar 11 during distance operation is substantially higher than the advance rate could be effective by the displacement of the force follower 39 in accordance with the force lever configuration during distance operation, operating the trigger 31 in distance operation of the incremental actuator moves both the distance follower 41 as well as the force follower 39 in the advance direction V. In this arrangement the slide bar 11 has no movement relative to the distance follower 41 during distance operation but the slide bar 11 is displaced relative to the force follower 39.

Accordingly, the lever configuration (force active lever wk) responsible for force operation of the incremental actuator 21 is also in function during distance operation without, however, acting on the slide bar 11 in any lever force transmitting way. Thus the spacing between the force follower 39 and the distance follower 41 as shown in FIG. 2 does not represent the actual displacement increment of the incremental actuator in distance operation, because the force follower 39 is also displaced by roughly the product of the force active lever wk and the sine of the angle $\alpha$. The actual increment of the incremental actuator 21 in distance operation is roughly determined by the product of the distance active lever ww and the sine of the angle $\alpha$.

Force Operation of the Incremental Actuator 21

In force operation of the incremental actuator 21 the slide bar 11 is displaced in the advance direction V only in small increments, resulting in lighter increases in tension between the fixed jaw 5 and movable jaw 13.

Figure 3:
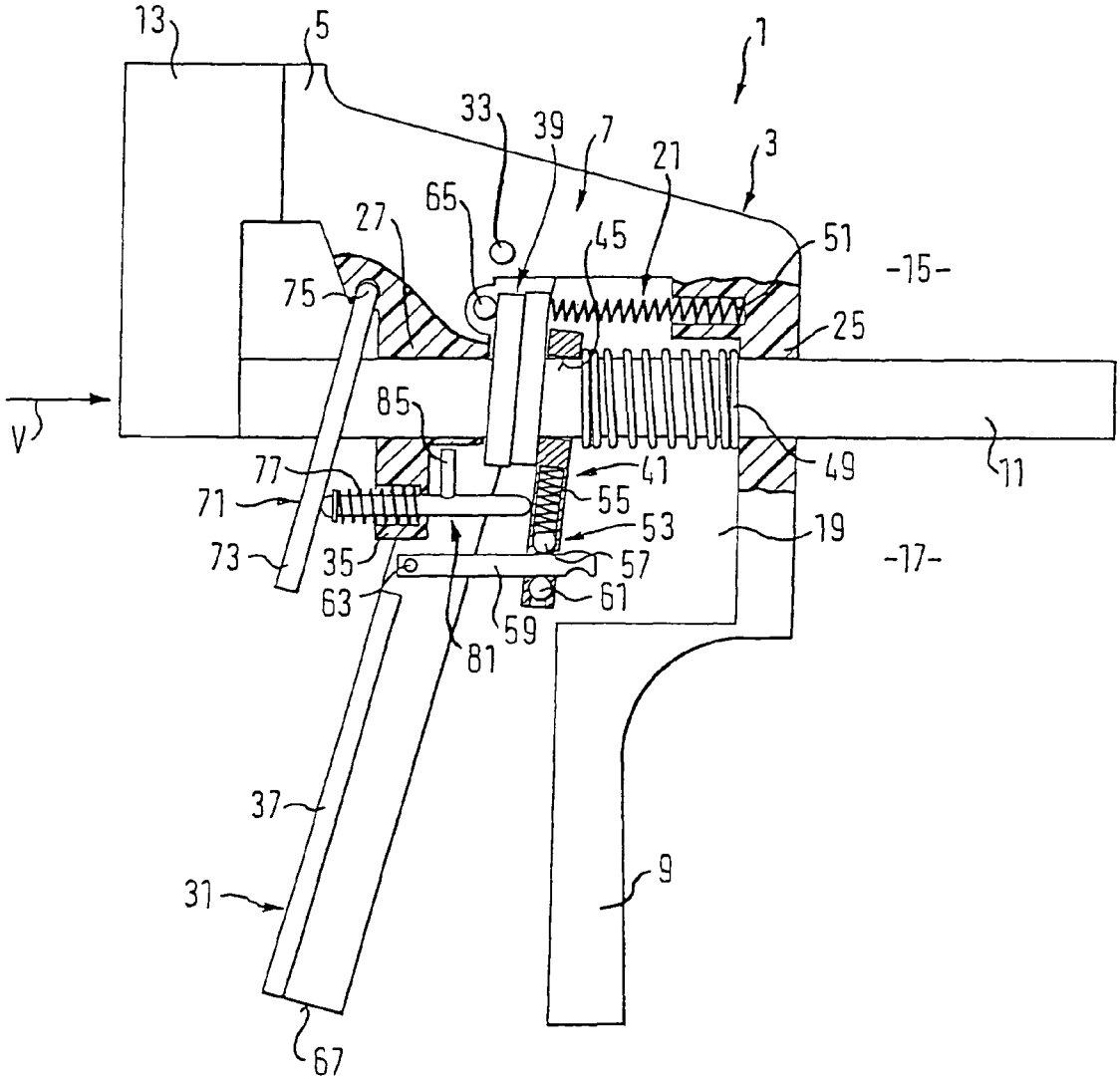
FIG. 3 is a side view of the tool as shown in FIG. 1, but with the small-increment force actuation mode activated.

In force operation the force active lever wk of the trigger 31 is effective. Referring now to FIG. 3 there is illustrated the decoupling means 53 in its activated condition. The pin 61 is urged from the dished mount so that the distance follower 41 can be shifted by the return spring 49 unobstructed contrary to the advance direction V to the pivot mount 33 by the distance follower 41 no longer being forced in a tilted position by the rigid coupling by means of the coupling rod 59.

The decoupling means 53 is then activated when a force is communicated to the trigger 31 by the operator which exceeds the release force threshold preset by the decoupling means 53. This actuating force is applied operationally only when a clamping force is needed between the fixed jaw 5 and movable jaw 13, namely when an item to be clamped is to receive clamping forces. This scenario is indicated in FIG. 3 by the contact of the jaws 5, 13.

Due to the coupling rod 59 being uncoupled from the distance follower 41 the distance active lever ww of the trigger 31 is no longer effective.

As explained above, the trigger 31 at the force transmission location 65 (force active lever wk) is permanently in contact with the force follower 39 throughout full operation of the incremental actuator as is produced by the return spring 51. This results in the force lever configuration becoming directly effective in achieving a continual advance of the slide bar 11 without interruption by the change-over due to decoupling on continued actuation of the trigger.

Due to the small force active lever wk it is evident that when the trigger 31 is actuated by an actuating stroke (α) a much smaller increment is achieved than in distance operation with the distance active lever ww as described above.

Figure 4:
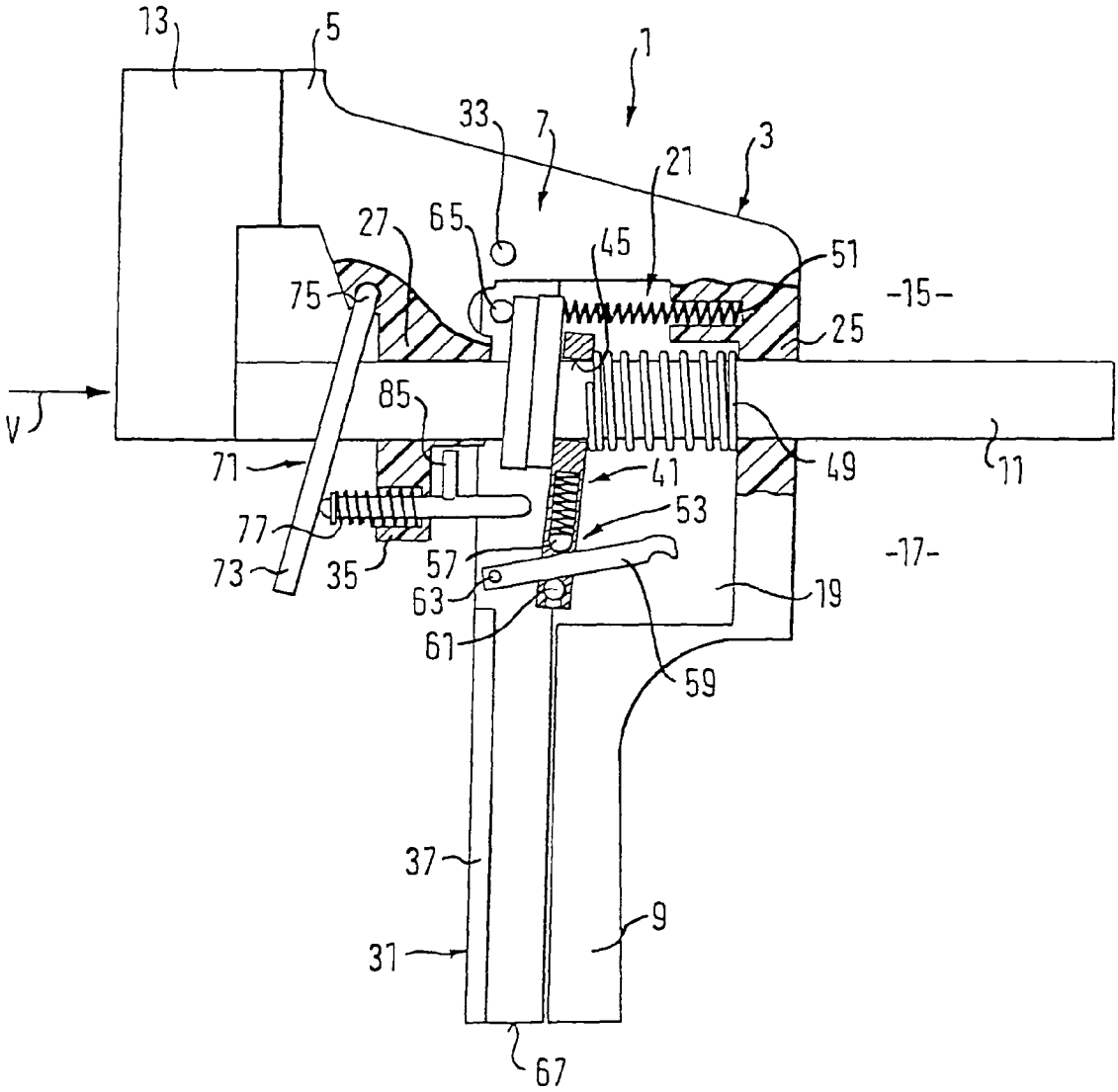
FIG. 4 is a side view of the tool as shown in FIG. 1, showing the force actuation mode at the end of the stroke.

Referring now to FIG. 4 there is illustrated how actuating the trigger 31 in force operation by an actuating stroke (α) results in the trigger 31 being in contact with the handle grip 9. Releasing the trigger 31 results in it being returned to the idle position because of the return spring 51. This is evident from FIG. 3. Since the return spring 49 urges the deactivated distance follower 41 against the force follower 39 the pin 61 is unable to return latch into the dished end portion of the coupling rod 59 in thus making a repeat actuating stroke possible without delay with this force lever configuration.

Releasing the Clamping Force and Recoupling

Figure 5:
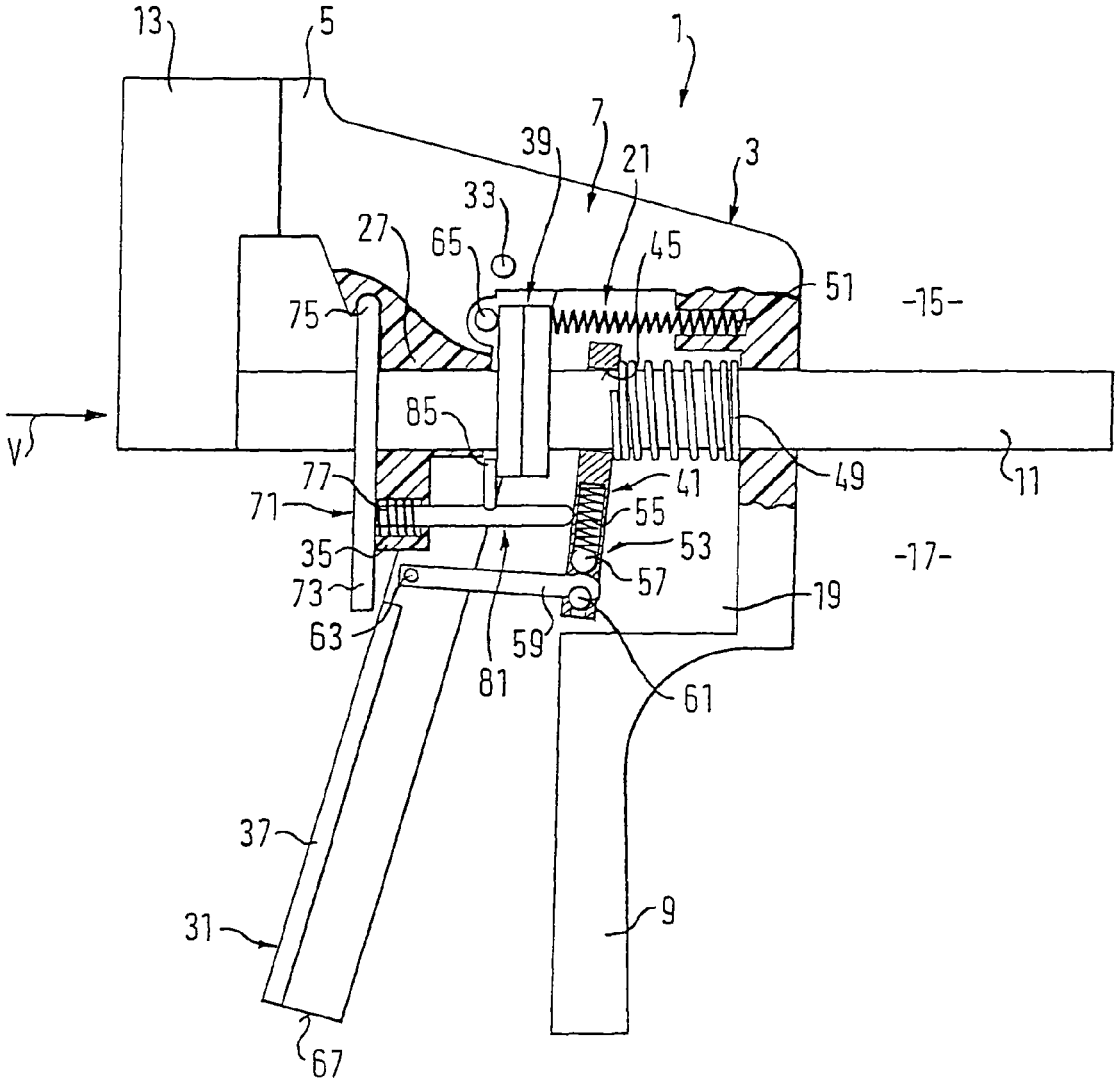
FIG. 5 is a side view of the tool as shown in FIG. 1 showing the distance actuation mode reinstated.

Referring now to FIG. 5 there is illustrated how to release the clamping force effective between the fixed jaw 5 and movable jaw 13 the lock 71 needs to be actuated by its actuating portion 73 at the actuating side in the advance direction V so that the actuating portion 73 is pivoted at the mounting part 75 and the tilt is released with the slide bar 11 which is responsible for maintaining the clamping force between the jaws 5 and 13 because of the closed force circuit from one jaw via the lock 71 into the slide bar 11 and further into the other jaw 13.

Again as indicated in FIG. 5 actuating the lock 71 simultaneously actuates the recoupling means 81, resulting in the elongated component of the recoupling means 81 being urged in the advance direction V in overcoming the bias of the locking spring 77.

As evident from FIG. 3, in the idle position of the trigger 31 in force operation of the incremental actuator 21 the distance follower 41 is in contact with the free end of the elongated component so that actuating the lock 71 directly affects the distance follower 41. When the lock 71 is actuated the return spring 49 causes the distance follower 41 to pivot about the end portion of the return spring 49 at the distance follower 41 so that the pin 61 is able to couple into the dished end portion of the coupling rod 59, as evident from FIG. 5.

Again as indicated in FIG. 5 a follower 85 results in release of the permanently tilted force follower 39. By releasing the lock 71 and tilting the force follower 39 the bar can be shifted contrary to the advance direction V to part the jaws 5 and 13 in preparation for a new clamping zone 23.

Permanently Tilted Force Follower 39

As explained above, the force follower 39 is maintained in a permanently tilted position relative to the slide bar 11 to permit force operation at any location along the slide bar 11.

The tilted position of the force follower 39 permits changing from the large increment mode to the small increment mode of the incremental actuator 21 even during an actuating stroke of the trigger without any loss of actuating distance.

The distance follower 41 too, is maintained in a permanently tilted position relative to the slide bar 11 by the coupling rod 59 cooperating with the return spring 49 when the decoupling means 53 is deactivated.

Referring now to FIGS. 6 to 11 there is illustrated a second preferred embodiment of the tool in accordance with the invention and incremental actuator in accordance with the invention respectively. The tool is illustrated in the configuration of a bar clamp 101, including a carrier 103 comprising a fixed jaw 105 and a housing 107, a reciprocating slide bar 111, at the one end of which a clamping jaw 113 is fixedly attached. The fixed jaw and the housing 107 may be made in one piece, more particularly injection molded in plastics material. The jaws 105, 113 are provided on a clamping side 115 of the slide bar 111, the opposite side of the slide bar 111 being termed the actuating side 117.

The housing 107 defines a cavity 119 in which organs of a dual-mode incremental actuator 121 are accommodated. at least in part, providing two operating conditions, namely distance operation characterized by large displacements of the slide bar 111 and a force operation configured by small displacements for producing high clamping forces between the jaws 105 and 113.

Figure 6:
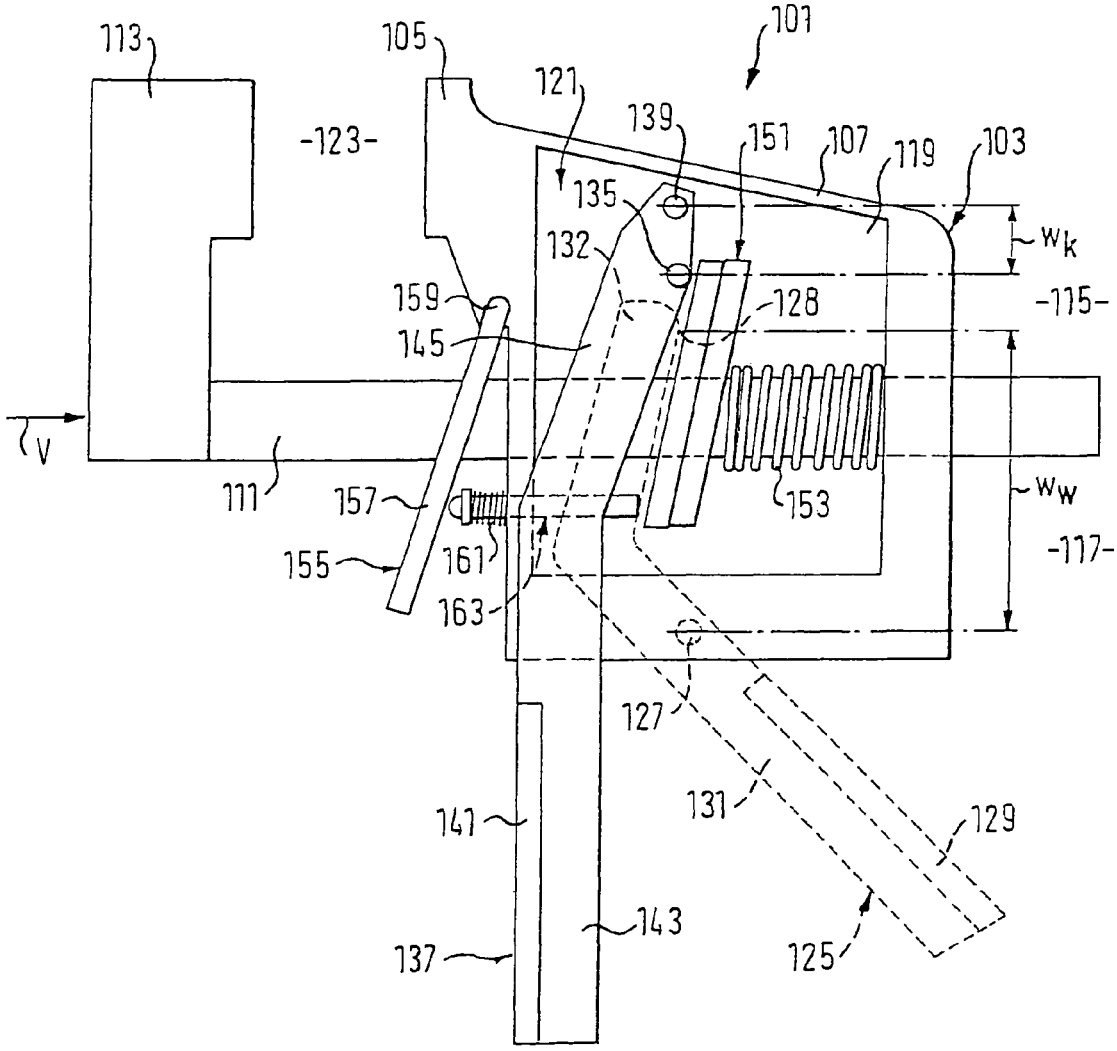
FIG. 6 is a diagrammatic side view but depicting realistic lever configurations of a tool in accordance with the invention in the configuration of a bar clamp in which a dual-mode incremental actuator is in an idle position.

In FIG. 6 the jaws 105 and 113 are shown separate from each other, between which a clamping zone 123 is definable in which an item to be clamped can be inserted.

The incremental actuator 121 with its two increments comprises a distance trigger 125 indicated by a dotted line for pivoting about a pivot mount 127. The pivot mount 127 is arranged at the actuating side 117 on the carrier 103.

The distance trigger 125 comprises an inset grip inlay 129 featuring a high friction coefficient. In addition, the distance trigger 125 comprises a first portion 131 with the grip inlay 129 and a second portion 132, the two portions 131, 132 being arranged at an angle of approx. 125 deg.

The distance trigger 125 comprises a non-variable permanent lever configuration defined by the active lever ww. The length of the active lever is determined by the spacing of the pivot mount 127 from a force transmission location 128.

In addition, the incremental actuator 121 in accordance with the invention comprises a force trigger 137 for pivoting about a pivot mount 139 arranged at the clamping side 115 on the carrier 103. The force trigger 137 comprises a grip inlay 141 located at the side of the force trigger 137 facing away from the distance trigger 125. As evident from the arrangement of the grip inlay 141, grip inlay 129 the bar clamp 101 can be gripped either by the force trigger 137 or by the distance trigger 125.

The force trigger 137 comprises a first arm portion 143 and a second arm portion 145 located at an angle of approximately 160° to each other. The lever configuration of the force trigger 137 is defined by the force active lever wk, the length of which is definable by the spacing of the pivot mount 139 of the force trigger 137 from the force transmission location 135, configured as a pin secured to the force trigger 137.

The incremental actuator in accordance with the invention comprises a sole follower 151 formed by two parallel plates. The follower 151 comprises a through passage (not shown) through which the slide bar 111 can pass with a clearance. The distance trigger 125 and force trigger 137 are engaged by a follower 151 at the clamping side 115.

The return spring 153, surrounding the slide bar 111 as a coil spring, is supported on the one hand by the inner side of the radially mounting portion of the carrier 103 whilst on the other it biases the follower 151 contrary to the advance direction V.

Referring now to FIG. 6 there is illustrated the idle position of the force trigger 137 in which the force trigger 137 contacts a stop (not shown) of the housing 107 at the actuating side 117 so that the force trigger 137 as well as the force transmission location 135 cannot be pivoted contrary to the advance direction V. Due to the return spring 153 the follower 151 is urged contrary to the advance direction V against the force transmission location 135 in assuming a tilted position in which the follower 151 is tilted with the slide bar 111. It is in this way that a tilted position of the follower 151 is made available in the non-actuated condition of the force trigger 137.

Provided at a side of the housing 107 facing the clamping zone 123 pivotally mounted is a lock 155 comprising a actuating portion 157. A pivot portion 159 cooperates with a recess provided at clamping side of the housing 107 such that the lock 155 is held on the housing 107 for pivoting about the pivot portion 159.

The lock 155 has a through passage through which the slide bar 11 can pass with a clearance. A locking spring 161 forces the lock 155 into a position permanently tilted relative to the slide bar 111 so that the lock 155 is tilted relative to the slide bar 111 in preventing a displacement (backslip) of the slide bar 111 contrary to the advance direction V.

The actuator in accordance with the invention also comprises a means 163 for releasing the tilted position, arranged on the actuating side on the housing 107. The means 163 is formed as an elongated component shiftingly mounted on the housing portion at the actuating side and biased by the locking spring 161 contrary to the advance direction V.

Distance Operation of the Incremental Actuator 121

Figure 7:
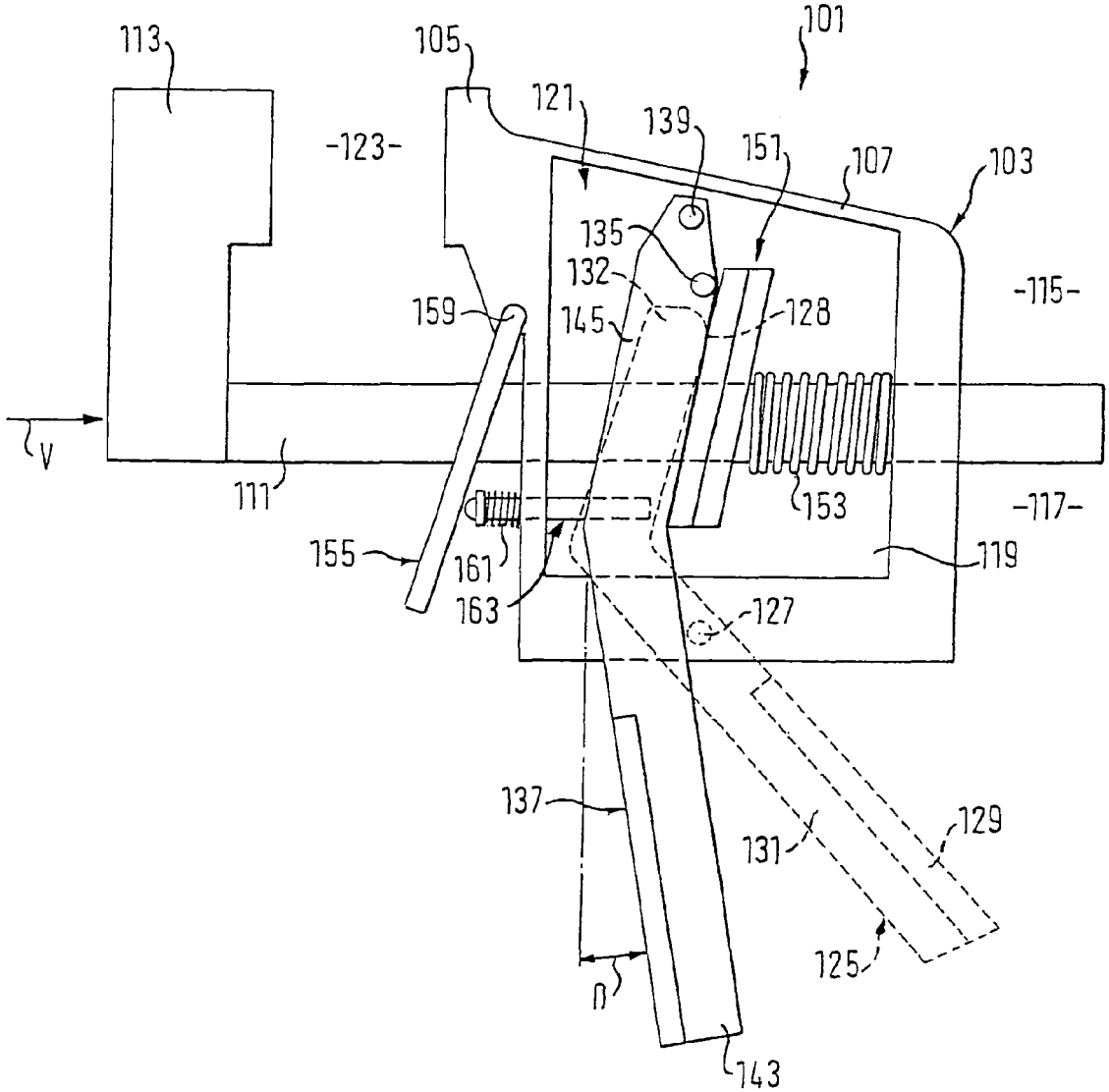
FIG. 7 is a side view of the tool as shown in FIG. 6 showing a force trigger positioned in a counterbearing position.
Figure 8:
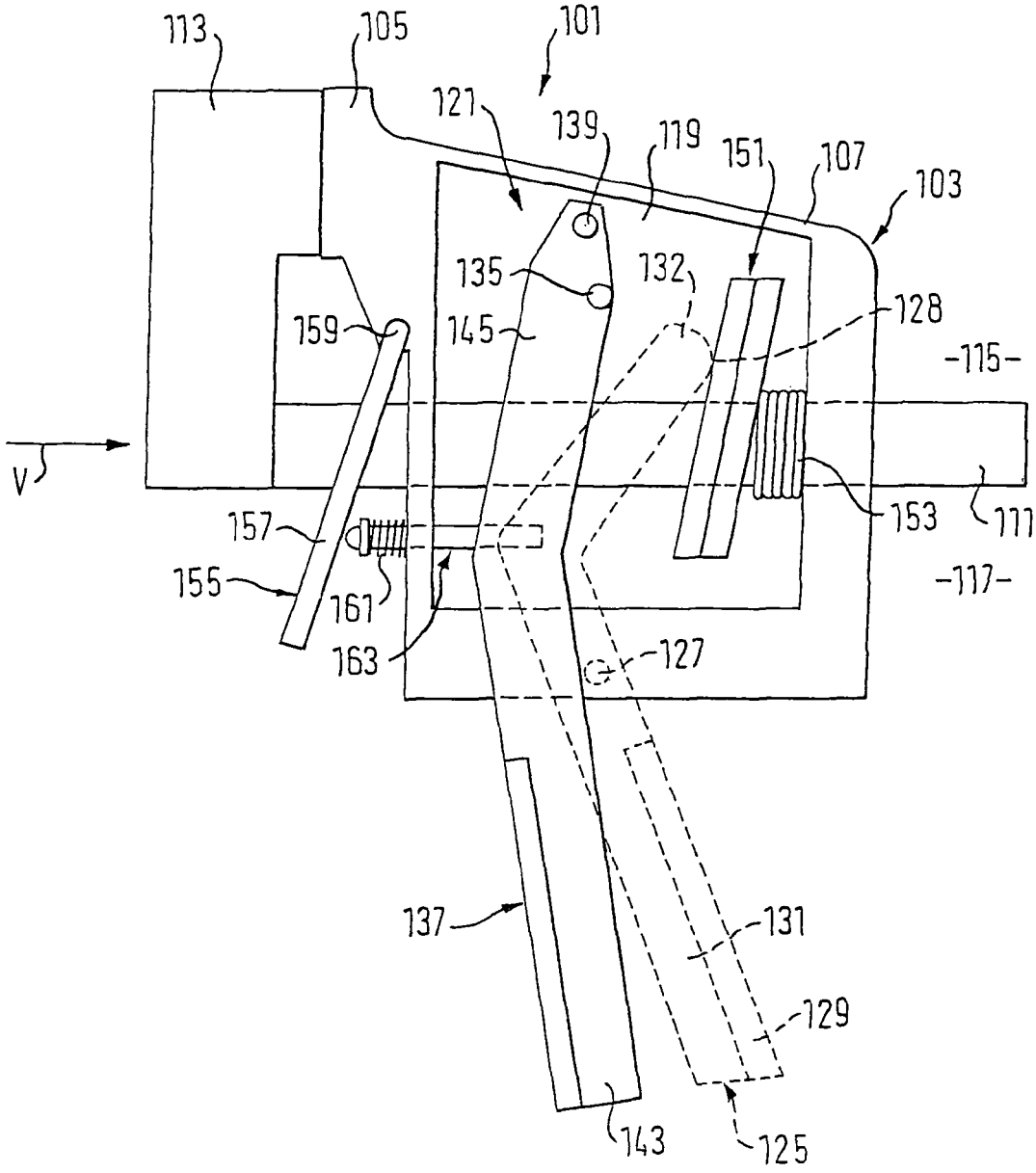
FIG. 8 is a side view of the tool in accordance with the invention as shown in FIG. 6 showing a distance trigger in an actuated operating condition as indicated by the dotted line.

Referring now to FIGS. 6 to 8 there is illustrated three operating positions for distance operation of the incremental actuator, FIG. 6 showing a non-actuated position, FIG. 7 an intermediate position and FIG. 8 an actuation end portion.

In the starting position as shown in FIG. 6 the bar clamp 101 is gripped so that the distance trigger 125 lies in the palm of the hand and the force trigger 137 is gripped by at least the middle finger and/or index finger.

Due to the permanently tilted position of the follower 151 even the smallest actuating stroke of one of the triggers 125 or 137 results in a displacement of the slide bar 111.

Referring now to FIG. 7 there is illustrated how before the distance trigger 125 becomes active, the force trigger 137 is pivoted about a pivot range □ to bring the force trigger 137 into its counterposition in which the force trigger 137 contacts the pivot mount 127 of the distance trigger 125 by its side facing the distance trigger 125. In the counterposition the force trigger 137 cannot be further pivoted towards the distance trigger 125. The follower 151 is already displaced in the advance direction V by the force lever configuration coupled to the force active lever wk in this first actuating phase of the force trigger 137. It is to be noted that this displacement corresponds to the increment in force operation.

Once the force trigger 137 has attained the counterposition as shown in FIG. 7 the large increment displacement, the same as in distance operation of the incremental actuator 121, can be attained. As evident from FIG. 8 the distance trigger 125 is pivoted towards the stationary force trigger 137 in accordance with the distance lever configuration in which the distance active lever ww is effective.

Referring now to FIG. 8 there is illustrated how in a full actuating stroke of the distance trigger 125 the return spring 153 is compressed. Releasing the force actuating the distance trigger 125 (FIG. 9) results in the return spring 153 urging the follower 151 from its tilted position in returning it to the force trigger 137, more particularly to the force transmission location 135. This return of the follower 151 takes place in continual contact with the force transmission location 128 of the distance trigger 125 at the end thereof at the clamping side.

If the item to be clamped (not shown) has yet to be gripped (see FIG. 7) the distance trigger 125 can be again actuated after having attained the position as shown in FIG. 7, until the jaws 105 and 113 have gripped the item to be clamped (not shown).

Force Operation of the Incremental Actuator 121

Figure 9:
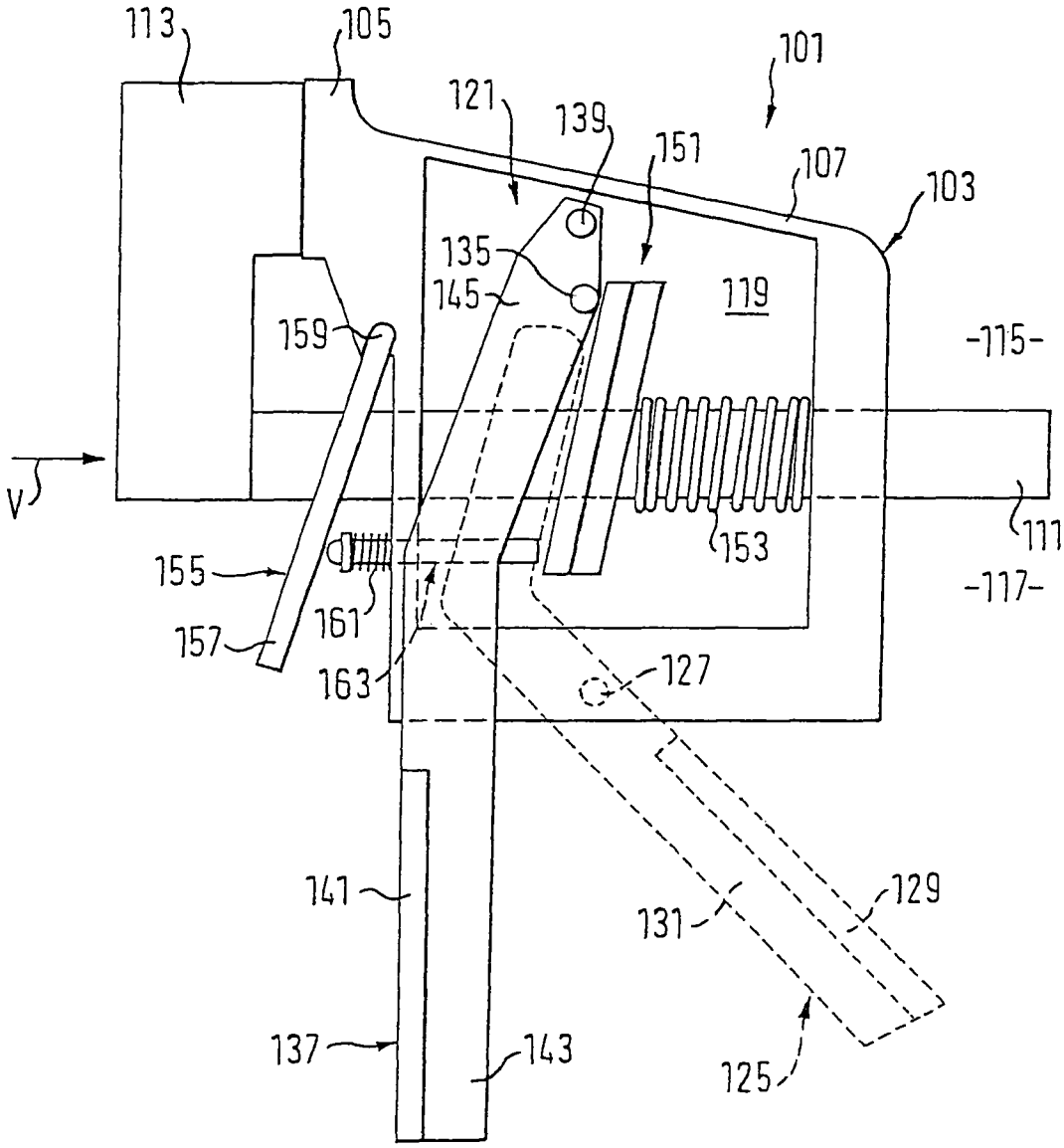
FIG. 9 is a side view of the tool in accordance with the invention as shown in FIG. 6 showing a positive contact between the fixed and movable jaws.
Figure 10:
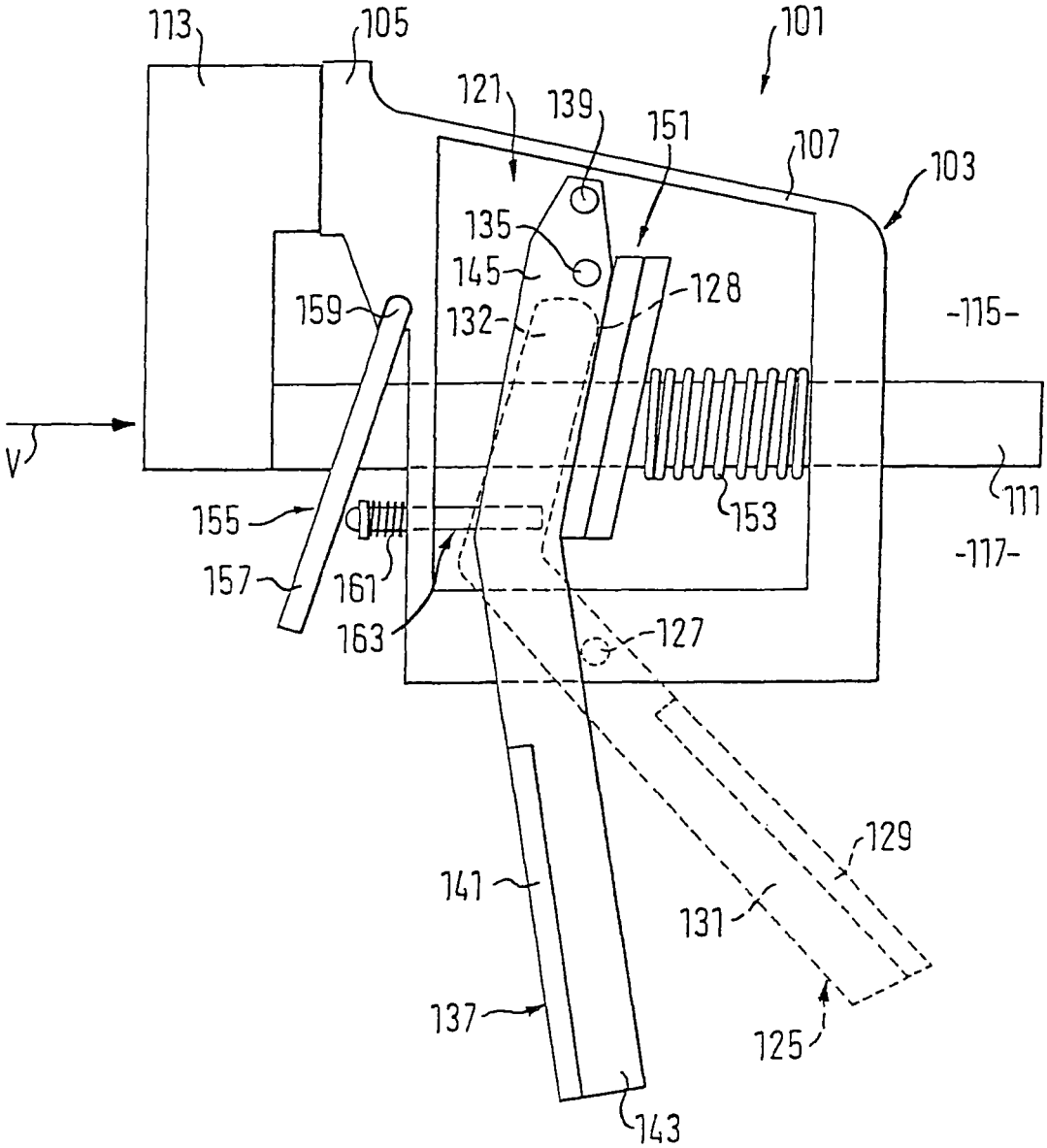
FIG. 10 is a side view of the tool in accordance with the invention as shown in FIG. 6 showing the force trigger in an actuated operating condition.
Figure 11:
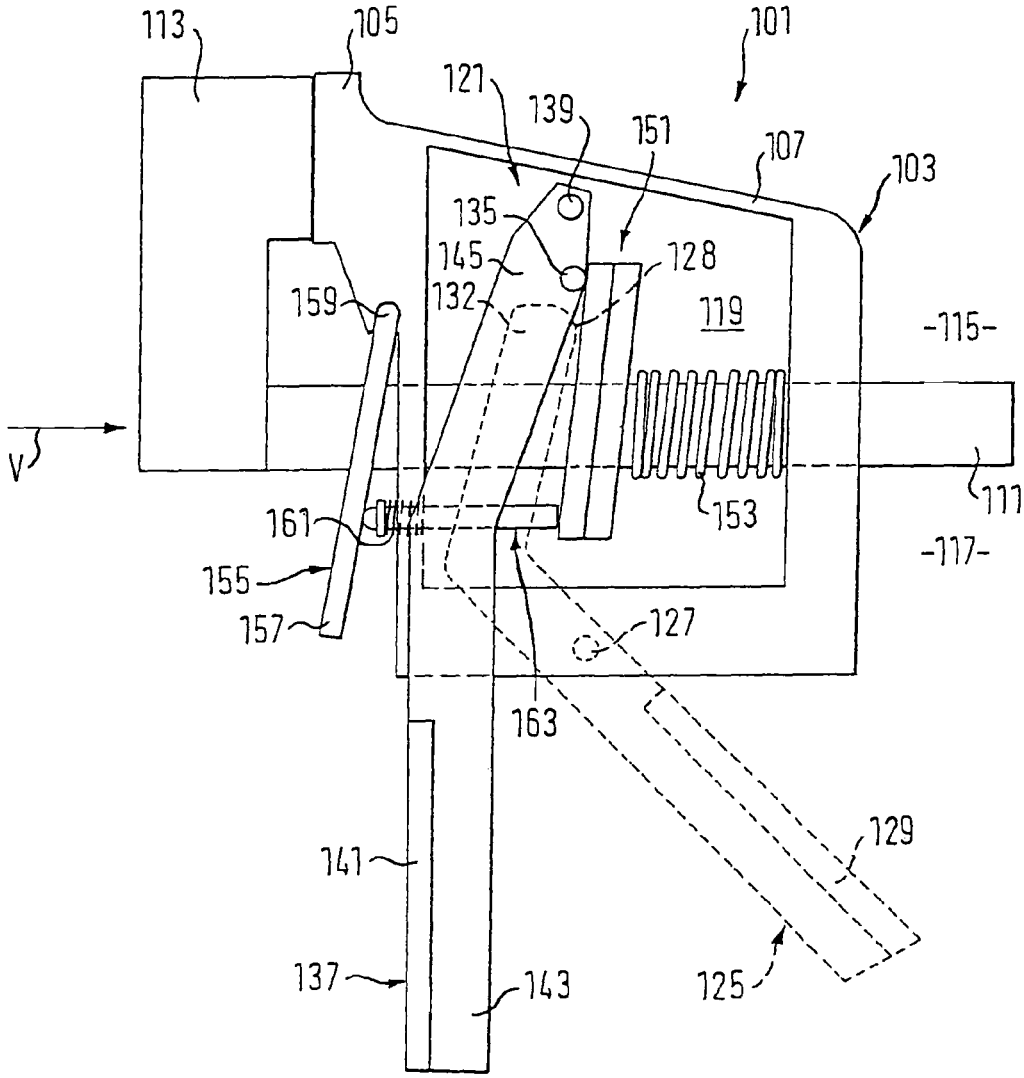
FIG. 11 is a side view of the tool in accordance with the invention as shown in FIG. 6 showing how jaw tension is released by actuating a release lever.

Referring now to FIGS. 8 to 10 small increment force operation of the incremental actuator will now be detailed. Force operation is particularly good for application when high clamping forces need to be applied by the jaws 105 and 113 as is indicated in FIGS. 8 to 10 by the jaws 105, 113 being in direct contact.

Once the two jaws 105, 113 are in contact no further actuation of the distance trigger 125 is possible since the large distance active lever ww requires enormous forces to achieve a displacement of distance increment. Accordingly, the distance trigger 125 in force operation of the incremental actuator is to be appreciated as a counterarm with respect to which the force trigger 137 can be pivoted.

Before the force actuating stroke is achievable the force trigger 137 needs to be moved from its end portion as shown in FIG. 7 into the starting position as shown in FIGS. 6 and 9. For this purpose the force trigger 137 is to be released so that the return spring 153 is able to produce the necessary pivoting movement about the pivot mount 139 into the starting position via the follower 151 and the force transmission location 135.

In force operation of the incremental actuator 121 the distance trigger 125 is used as a counterarm. The force trigger 137 is pivoted until the side of the force transmission location 135 facing the distance trigger 125 engages the pivot mount 127 of the distance trigger 125 as shown in FIG. 10. The force lever configuration produces small increments of constant actuating stroke so that the desired clamping forces can be induced in the jaws 105 and 113.

This action can be repeated by the force trigger 137 being released from the fingers of the operator (not shown), resulting in the return spring 153 returning the trigger to its starting position in readiness for a new force actuating stroke, as shown in FIG. 9.

Releasing the Clamping Force and Tilting

To release the clamping force between the jaws 105, 113 as maintained by the lock 155, the actuating portion 157 of the lock 155 needs to be actuated in simultaneously actuating the means 163 to release the tilt of the follower 151. When the lock 155 is actuated the elongated component of the means 163 urges the portion of the follower 151 at the actuating side, resulting in it being pivoted about the force transmission location 135 of the force trigger 137 to thus defeat its tilted position relative to the slide bar 111.

Deactivating the lock 155 and activating the means 163 permits displacing the slide bar 111 together with the movable jaw 113 contrary to the advance direction V.

It is understood that the features of the invention as disclosed in the above description, in the drawing as well as in the claims may be substantial to achieving the invention in its various embodiments both individually and in any combination.

The invention claimed is:

1. A clamping and/or spreading tool, the clamping and/or spreading tool comprising:

a stationary jaw;

a support fixedly connected to said stationary jaw;

a push or pull rod slideably supported on said support;

a distance driver engageable with the push or pull rod;

a force driver engageable with the push or pull rod;

a movable jaw fixedly arranged on the push or pull rod; and a trigger defining a first lever arm and a second lever arm, the trigger operably connected to the distance driver by a decoupling mechanism, the decoupling mechanism comprising a coupling rod and a release mechanism, wherein the trigger defines the first lever arm when the trigger applies a force to the distance driver through the coupling rod, and wherein the trigger defines the second lever arm when the trigger applies a force to the force driver when the release mechanism disconnects the coupling rod from the distance driver.

2. The clamping and/or spreading tool according to claim 1, wherein the release mechanism disconnects the trigger from the distance driver when a threshold force is applied to the trigger.

3. The clamping and/or spreading tool according to claim 1, wherein the coupling rod comprises a first end connected to the trigger at a first hinge and a second end connected to the distance driver by means of a dished end portion pressure mated to a ball, wherein the dished end portion releases from the ball when a threshold force is exceeded.

4. The clamping and/or spreading tool according to claim 3, further comprising a spring that urges the dished end portion against the ball.

5. The clamping and/or spreading tool according to claim 1, wherein the first lever arm displaces the push or pull rod a first distance and the second lever arm displaces the push or pull rod a second distance, wherein the first distance is larger than the second distance.

6. The clamping and/or spreading tool according to claim 1, further comprising a lock configured to prevent displacement of the push or pull rod in a reverse direction, the lock being actuatable to allow displacement of the push or pull rod in the reverse direction.

7. The clamping and/or spreading tool according to claim 6, wherein the lock comprises a recoupling mechanism for reconnecting the coupling rod to the release mechanism when the lock is actuated.

8. A clamping and/or spreading tool, the clamping and/or spreading tool comprising:

a stationary jaw;

a support fixedly connected to said stationary jaw;

a push or pull rod movably supported on said support;

a movable jaw fixedly arranged on the push or pull rod;

a first trigger pivotably attached to the support; and a second trigger pivotably attached to the support, wherein actuating the first trigger in a first direction displaces said push or pull rod in an advance direction, and wherein actuating the second trigger in a second direction displaces said push or pull rod in the advance direction.

9. The clamping and/or spreading tool according to claim 8, wherein said first trigger and said second trigger are alternately operateable.

10. The clamping and/or spreading tool according to claim 8, wherein said first trigger and said second trigger are pivotably attached to said support such that said first trigger and said second trigger feature opposing actuating directions and act as counter arms to one another.

11. The clamping and/or spreading tool according to claim 8, wherein the first trigger and the second trigger are pivotably attached on opposite sides of the push or pull rod.

12. The clamping and/or spreading tool according to claim 8, wherein the first trigger is pivotably attached on the support on the opposite side as the fixed jaw such that when the first trigger is fully actuated, the push or pull rod advances a first distance, wherein the second trigger is pivotably attached on the support on the same side as the fixed jaw such that when the second trigger is fully actuated, the push or pull rod advances a second distance, and wherein the first distance is greater than the second distance.

13. The clamping and/or spreading tool according to claim 8, the push or pull rod being displaced by means of at least one driver, wherein the first trigger and the second trigger apply force to the at least one driver.

14. The clamping and/or spreading tool according to claim 8, further comprising a lock having a driver and an actuating portion, wherein the driver is reversibly engageable with the push or pull rod, wherein when the actuating portion is in a neutral position the push or pull rod is prevented from movement in a reverse direction and when the actuating portion is in a depressed position, the driver disengages from the push or pull rod and allows movement in the reverse direction.

* * * * *